US009587447B2

(12) United States Patent
Roodenburg et al.

(10) Patent No.: US 9,587,447 B2
(45) Date of Patent: Mar. 7, 2017

(54) DRILLING VESSEL

(71) Applicant: ITREC B.V., Schiedam (NL)

(72) Inventors: Joop Roodenburg, Delft (NL); Diederick Bernardus Wijning, Schiedam (NL); Pieter Dirk Melis Van Duivendijk, Missouri City, TX (US)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/894,255

(22) PCT Filed: May 27, 2014

(86) PCT No.: PCT/NL2014/050337
§ 371 (c)(1),
(2) Date: Nov. 25, 2015

(87) PCT Pub. No.: WO2014/193228
PCT Pub. Date: Dec. 4, 2014

(65) Prior Publication Data

US 2016/0102507 A1 Apr. 14, 2016

(30) Foreign Application Priority Data

May 27, 2013 (NL) ..... 2010865

(51) Int. Cl.
*E21B 19/10* (2006.01)
*E21B 19/16* (2006.01)

(52) U.S. Cl.
CPC ..... *E21B 19/10* (2013.01); *E21B 19/16* (2013.01)

(58) Field of Classification Search
CPC ..... E21B 19/02; E21B 19/09; E21B 19/10; E21B 19/16
USPC ..... 166/358, 75.14, 96.1; 175/85
See application file for complete search history.

(56) References Cited

U.S. PATENT DOCUMENTS

| | | | | |
|---|---|---|---|---|
| 2,351,887 | A * | 6/1944 | Steadman | E21B 19/10 175/423 |
| 4,382,361 | A * | 5/1983 | Blanchet | E02F 3/88 37/310 |
| 4,716,972 | A | 1/1988 | Mäkinen et al. | |
| 6,217,258 | B1 | 4/2001 | Yamamoto et al. | |
| 7,681,631 | B2 * | 3/2010 | Thomas, Jr. | E21B 3/04 166/378 |
| 2003/0159853 | A1 | 8/2003 | Archibald et al. | |

* cited by examiner

*Primary Examiner* — Kenneth L Thompson
*Assistant Examiner* — Steven MacDonald
(74) *Attorney, Agent, or Firm* — Birch, Stewart, Kolasch & Birch, LLP

(57) ABSTRACT

The invention relates to a drilling vessel (1) comprising a drilling tower (2) and a tubular string support structure (3) for supporting a tubular string in the firing line (4*a*, 4*b*) of the drilling tower. The tubular string support structure comprises two parallel rails (11) and two carts (13, 14) supported by those rails. Both carts have a hanger body (14, 15), comprising a central passage (16), for supporting a tubular, and each cart (13, 14) can be moved between a central support position (18) for supporting a tubular in the firing line, and a secondary position (19) adjacent the central support position. When both carts (13, 14) are located in their secondary position (19), the carts are located on opposite sides of the firing line, such that between the carts there is a passage for passing through large objects along the firing line.

20 Claims, 11 Drawing Sheets

DRILLING VESSEL

FIELD OF THE INVENTION

The present invention relates to a drilling vessel, e.g. for oil and gas exploration, well servicing, etc., the drilling vessel comprising a drilling tower having a firing line, along which a tubular string is passed into the sea during drilling activities, the firing line extending in a substantially vertical direction.

BACKGROUND OF THE INVENTION

In general drilling vessels are provided with tools and hang of clamps, such as riser spiders and slips, for working on, assembling, disassembling and supporting tubular strings in the firing line of the drilling tower. The tools and hang of clamps are typically designed to work a tubulars having a specific diameter. When tubulars of a different diameter are to be handled, the tools and of clamps are often replaced with tools and clamps that fit the diameter of the other tubulars. Changing of clamps and tools in the firing line costs time.

OBJECT OF THE INVENTION

The present invention aims to propose solutions to make optimum use of the firing line on a drilling vessel.

SUMMARY OF THE INVENTION

According to a first aspect, the invention provides a drilling vessel according to claim 1. The drilling vessel is provided with two carts on opposite sides of the firing line. While one cart can is located a the central support position for supporting tools and/or a tubular or tubular string located in the firing line, the other cart is located in its secondary position outside the firing line. Thus, work in the firing line can progress using the first cart, while the second cart is adapted to perform subsequent activities on the tubular string located in the firing line. The drilling vessel according to the first aspect of the invention thus allows to make optimum use of the firing line on a drilling vessel.

A drilling vessel according to the first aspect of the invention comprises a drilling tower having a firing line and a tubular string support structure. Along the firing line of the drilling tower, a tubular string is passed into the sea during drilling activities. The firing line extends in a substantially vertical direction and passes through an elongated opening. The tubular string can be a drilling string, i.e. a string of drilling tubulars, a casing string, i.e. a string of casing tubulars, etc.

In an embodiment, the elongated opening is provided in a deck, preferably a drilling deck. In a further embodiment the deck in which said elongated opening is provided is the deck that also supports the riser tensioners. In an embodiment, the drilling tower is supported by a part of the hull of the drilling vessel that also supports the deck in which the elongated opening is provided. For example, in an embodiment the drilling tower is supported by cross beams that also support at least a part of the deck in which the elongate opening is provided, such that the bottom end of the tower is located at substantially the same height of the deck in which the elongate opening is provided. Thus, when seen in cross section, the drilling tower does not extend below the deck both the deck and the drilling tower are supported by the same hull construction The tubular string support structure comprises two parallel rails and two carts. The two parallel rails are provided on opposite sides of the elongated opening, such that the firing line of the drilling tower passes through the elongated opening and between the rails.

It is noted that the rails can be provided in the form of beams that are part of the construction of the hull, or can be provided in the form of skid beams or actual rails supported by the hull of the vessel. In an embodiment, the support rails are provided below a top surface of the deck, preferably the drilling deck, in which the elongated opening is provided, such that the carts are at least partially recessed in the deck.

The two carts of the tubular string support structure each have a hanger body, which hanger body defines a vertical passage adapted to receive a tubular string supported in the firing line, for example by a hoisting device provide on the drilling tower for lifting and lowering tubulars. The hanger body defines a lateral passage, in communication with said vertical passage, allowing to place the tubular string in and remove the tubular string from said vertical passage.

The carts are each supported by the parallel rails such that each cart can be moved between a central support position, above the elongated opening with the firing line passing through the vertical passage, and a secondary position above the elongated opening with the firing line passing outside the vertical passage. Furthermore, when both carts are located in their secondary position, the carts are located on opposite sides of the firing line, such that between the carts there is a passage for passing through large objects along the firing line.

In an embodiment, the carts are provided in a recess in a deck, which recess also forms the elongated opening in a deck, preferably such that the carts are supported such that the top side of the carts is substantially flush with the top surface of the deck or such that the top side of the carts is located below the top surface of the deck in which the elongate opening is provided. In such an embodiment the elongated opening essentially forms a recess or groove in the deck structure, in which recess or groove the carts are located. In a further embodiment, the carts are provided in a recess in a deck that is located above the elongated opening, and which is preferably dimensioned substantially similar to the elongated opening. In an alternative embodiment, the carts are provided in a recess in the deck that overlaps with the elongated opening. For example, the elongated opening overlaps with the central support position, while the carts in their secondary positions are located adjacent the elongated opening, when seen in top view.

In a further embodiment, the tubular string support structure is provided in a deck section which is pivotable or slideable into and out of a position above a moonpool or similar. For example, by providing the tubular support structure in a pivotable deck section, the tubular support structure can be removed be pivoting the deck section, for example into a vertical, upright position, to lift or lower products along the firing line which products are to large to be passed between the two parallel rails and/or the carts located in their secondary positions.

Due to the c-shape of the hanger bodies, i.e. the hanger bodies defining a vertical passage combined with a lateral passage, the carts can be moved into and out of the central support position while a tubular is supported in the firing line. Thus, a tubular can be supported by a tubular string support structure mounted on the tower, for example a winch or a trolley, which tubular string support structure is configured for lowering, lifting and supports one or a string of tubulars in the firing line.

In an embodiment, the firing line is provided on the outside of the tower. It is noted that a drilling tower with one or more firing lines provided outside the structure of the tower is often referred to as a mast type tower. When the firing line is provided outside the tower, the elongate opening in which the two carts are provided is also located outside the confines of the tower. In a preferred embodiment, the drilling tower is a mast type tower with the firing line located outside the mast, and the secondary position of one of the carts is located between the central support position and the mast.

Preferably, the elongated opening, in which the two carts are provided, has a longitudinal axis that extends in a direction away from the drilling tower. In such an embodiment, the one cart has a secondary position between the central support position and the drilling tower. The secondary position of the other cart is located on the opposite side of the central support position such that that cart moves away from the tower when it Furthermore, when the vessel is provided with a moonpool, the elongated opening, in which the two carts are provided, preferably has a longitudinal axis that extends in a direction parallel to a longitudinal axis of that moonpool.

It is noted that with some drilling vessels, the drilling tower comprises two firing lines, provided on opposite sides of the tower. With such a vessel, the tubular string support structure according to the invention can be provided at one or at both sides of the drilling tower. In the latter case, each firing line is provided with two carts according for the invention to allow for a quick change of clamps and/or tools. Thus, the drilling vessel according to the invention comprises a mast type drilling tower with the firing lines located outside the mast and on opposite sides of the mast. Thus, the present invention also provides an improved multiple firing line drilling vessel. Preferably, with both firing lines, the secondary position of one of the carts is located between the central support position and the mast.

With a drilling vessel according to the first aspect of the invention, one cart can be located in the central support position for supporting tools and/or a tubular or tubular string located in the firing line, while the other cart is located in its secondary position outside the firing line. Tools can be mounted on the second cart and/or the second cart can be adapted for supporting a specific kind of tubular while that cart is positioned in its secondary position. Thus, work in the firing line can progress using the first cart, while the second cart is adapted to perform subsequent activities on the tubular string located in the firing line. Furthermore, the new tools can be positioned in the firing line by simply moving the first cart out of the central support position and into its secondary position, and moving the second cart into the central support position.

In another embodiment according to the invention, both carts comprise the same type of tool, but each tool is dedicated to a specific type or range of tubulars. For example, both carts are provided with a tubular support device, for example both carts are provided with a tubular clamping device, one of which is dedicated for use with a first type or range of tubulars, for example tubulars having a first diameter, and the other of which is dedicated for use with a second type or range of tubulars, for example tubulars having a second diameter.

The drilling vessel according to the first aspect of the invention thus allows making optimum use of the firing line on a drilling vessel.

In an embodiment the carts are both provided with a deck surface, preferably substantially level with the deck surface of the deck in which the elongated opening is provided, such that the carts each form a slideable deck section, the deck sections preferably having dimensions of at least 2 by 2 meter, for example 2.5 by 2.5 meter, more preferably of at least 3 by 3 meter, for example 4 by 4 meter. Preferably, the carts thus each form a slideable deck section, which deck sections are part of the drilling deck of the drilling vessel. Thus, with a tubular string support according to the invention not only the clamping device for supporting the tubular in the firing line is being removed when a cart is moved from the central support position to the secondary position, but also the drilling deck used by personnel when the cart is in the central support position.

In such an embodiment, not only the hanger body, i.e. the tool for manipulating tubulars or the body supporting tools for manipulating tubulars is replaced, but also the working deck located around the firing line.

In an embodiment the tubular support structure comprises a deck structure and a hanger body provided in that deck body, alternatively, the hanger body can itself form the deck surface or be provided with a deck surface mounted thereon.

In an embodiment, the deck surface of the carts forms the top surface thereof, and the vertical passage and preferably any actuable support devices of the cart are provided below the deck surface of the cart.

Replacing a part of the deck or drill floor instead of only the tools or devices mounted on the deck or drill floor or in an opening provided in the deck or drill floor, allows for a quick change of tools and devices that can interact with a tubular located in the firing line. It furthermore allows for integrating the tools and/or devices, such as clamping devices to be integrated in the deck part, i.e. provided below the deck surface of the cart, and thus allow for a free deck surface provides workers with freedom to operate.

By providing the two carts with secondary positions on opposite sides of the firing line, adjacent the central support position, the carts can directly be moved into and out of the central support position, which allows for a quick change of the carts, and thus of the deck parts provided on the carts.

In an embodiment, both carts are provided with couple devices for coupling the carts to each other such that the lateral passages of both carts are positioned opposite each other and an object that exits the lateral passage of one hanger body enters the lateral passage of the other hanger body. Thus, moving one cart from the central support portion into its secondary support position automatically moves the other cart from its secondary position into the support position, and a tubular supported in the firing line, for example by a hoisting device of the drilling tower, is moved from the central passage of one cart almost directly into the central passage of the other cart. This allows for a quick replacement of the carts located in the central support position by the cart located in its secondary position.

In an embodiment, the elongated opening and the two carts are dimensioned such that, when one of the carts is located in the central support position and the other cart is located in its secondary position, both carts are located adjacent each other, preferably contact each other, preferably contact each other such that a deck surface provide on the one cart forms an un interrupted deck surface with the deck surface provided on the other cart.

Furthermore, by coupling these carts when replacing the cart located in the central support position with the cart located in its secondary position, the deck of the first cart is directly replaced with the deck of the second cart during the transition. No openings, which might cause risk situations for personal, are thus created between the two decks during the transition.

In an embodiment both carts are configured for performing the same function, e.g. supporting a flange of a tubular or clamping the circumference of a tubular, but differ in the diameter of the tubular they can handle, for example differ in the diameter of the vertical passage, such that one cart can be used with tubulars having a first diameter and not with tubulars having a second diameter, and the other cart can be used with tubulars having the second diameter and not with tubulars having the first diameter. Such an embodiment can for example be used when switching from building a casing string to building a drilling string, which drilling string is with its lower end attached to the upper end of the casing string, for lowering the casing string into the drilling hole, which kind of drilling string is also referred to as a landing string. Alternatively, the first cart is configured for handling a first range of tubulars, e.g. tubulars having a diameter within a first range, and the second cart is configured for handling a second range of tubulars, e.g. tubulars having a diameter within a second range, which second range does not, or only partially overlaps with the first range. Such can for example be beneficial when building a tapering drilling string, i.e. a drilling string composed of the tubulars with reducing diameter when seen from top to tip. Thus, both carts are dedicated to a specific function, for example are both provided with extendable slips for engaging and clamping a tubular body in the firing line to support it, but are each tuned to work with tubular bodies of a specific diameter. Thus, more dedicated tools can be used, while the drawback of time consuming replacing, remounting, and tuning of those tools preventing work being done in the firing line each time for example the diameter of the tubulars to be handled changes, can be avoided.

In an embodiment according to the invention the carts are each supported by the parallel rails such that when they are located in their secondary position, their lateral passages are directed towards the firing line. Thus, the carts are optimally positioned for quickly replacing each other.

In a further embodiment, the carts, when located in their secondary position, are positioned directly adjacent the cart in the central support position, such that an overall compact configuration is achieved in combination with an optimal positioned for quickly replacing one cart located in the central support position with the other cart. In a further embodiment, the carts are coupled, such that when one cart is moved out of the central support position, the other cart is pulled into the central support position.

In an embodiment, the carts are configured such that they can be lifted from the supporting rails, preferably when located in their secondary position, to enable the cart to be replaced with another cart, for example to be replaced with a cart configured for supporting tubulars having different dimensions.

In a further embodiment, both carts are at opposite sides of the lateral passage provided with support sections at their topside, and both carts can be positioned partially in or adjacent to the central support position at the same time, such that the carts can together support an object, e.g. spider gimbal, located in the firing line.

For example, both carts can be moved from their secondary position towards the firing line, such that the distance between the two carts is reduced and both carts are partially located in the central support position at the same time, while the firing line passes between both carts. Subsequently, an object such as a riser spider is placed in the firing line such that it's opposite ends are located on the carts positioned on opposite sides of the firing line. Thus, the carts together support the riser spider in the firing line.

In an embodiment, both carts are at opposite sides of the lateral passage provided with couple devices for cooperating with couple devices of an object located in the firing line, e.g. a spider gimbal provided with such couple devices, and wherein both carts can be positioned partially in or adjacent to the central support position at the same time, such that the carts can together engage such an object to support it in the firing line. In such an embodiment, the side of a cart that faces the other cart is provided with these coupling means, and the coupling means of the respective carts can be moved towards each other by moving the carts towards the firing line. Thus, an object such as an intermediate provided between two tubulars of a tubular spring can be engaged, on opposite sides, by the coupling means of the respective carts. For example, the carts can be provided with pins that extend from the cart towards the other cart, and an object located in the firing line can be provided with recesses for receiving those pins, such that the carts can be coupled with the object by moving the carts towards the object and thus inserting the pins provided on the carts in the openings proceed in the sides of the object.

In an embodiment, the hanger body of at least one cart is configured with the vertical passage having a diameter wider than the lateral passage, such that, when seen in top view, the combined vertical passage and lateral passage form a key hole shaped opening. Such a cart is preferably furthermore provided with grips that can be inserted into the central opening to engage a tubular extending through said opening. For example, the cart can be provided with recess shaped for receiving and supporting gripping blocks, which can be placed into said openings to reduce the diameter of the central opening and engage tubular extending through the vertical passage or for supporting the flange of a tubular extending through the central passage. In addition, or as an alternative, the cart can be provided with retractable jaws or dogs that can be inserted into the vertical passage to support a flange of a tubular of a riser string. In an embodiment, at least one cart is configured for receiving slips such that the vertical passage can be adapted to the particular cross section of a tubular string.

In an embodiment, at least one cart is provided with three or more clamping blocks, which clamping blocks are provided along the circumference of the vertical passage at even intervals such that they can engage a tubular string passing through said vertical passage, and which clamping blocks can be moved in a radial direction with respect to a central axis of the vertical passage, such that tubular strings of different diameter can be engaged with said clamping blocks.

In a further embodiment, the cart is provided with a vertical guide for each clamping block, such that the clamping blocks are moveably supported in the central passage for movement in a diagonal direction, i.e. upward in combination with radially outward and downwards in combination with a radially inward. Thus, the clamping blocks can be used as slips for supporting, and clampingly engaging, a tubular located in the vertical passage of the cart. In a further embodiment, the clamping blocks are provided with pads for engaging the tubular string. Thus the pads can be replaced when worn out, or to fit a particular circumferential shape or dimension of a tubular supported in the vertical passage of the cart.

In an embodiment, at least one cart is provided with a closing device configured for closing the lateral passage, for example is provided with a door that can block the lateral passage, which closing device preferably is designed to provide the hanger body with a ring shaped vertical passage when the lateral passage is closed. In such an embodiment, the closing device can be used for converting the c-shaped clamp into a ring shaped support, which in turn allows for an even distribution of the weight load of the riser string supported by the cart in the central passage thereof.

In an embodiment, the hanger body of at least one cart is provided with a frusto-conical shape, to facilitate interaction with standard slips.

In an alternative embodiment, the hanger body of each cart comprises a frame composed out of multiple frame sections, which frame sections preferably are hingeable connected, and wherein one or more frame sections of the frame can be pivoted between an open position, in which the frame sections form a C-shaped hanger body, and a closing position, in which the pivotable frame sections close the opening of the C-shaped hanger body.

In an embodiment, the hanger body is provided with multiple actuable, preferably hydraulically actuable, support devices, for example movable clamps or movable slips, which support devices can be moved into and out of the vertical passage for engaging a tubular in said vertical passage.

Preferably, the support devices, more in particular the parts for engaging a tubular, can be moved between an active extended position in which they extend in the vertical passage for supporting a tubular, and a retracted passive position, in which they allow for passing a tubular through the vertical passage in a vertical direction and/or into and out of the vertical passage via the lateral passage. In the latter, the parts for engaging the tubular are located adjacent or in the hanger body, or the frame that forms the hanger body.

Composing the frame out of multiple frame sections allows for a modular build, which is especially beneficial when the frame sections each frame section comprises an actuator device, for example for engaging a tubular located in the vertical passage. Thus identical frame sections, preferably combined with identical actuators, can be combined into a hanger body.

In a further embodiment, the support devices are configured such that they can be extended in a range of active positions, such that the active position of the support devices can be adapted to fit the diameter of a tubular in the vertical passage, and the hanger body can thus be used with a range of tubulars, more in particular with tubulars having a first diameter.

In an embodiment, the tubular string support structure further comprises a bearing support, the bearing support defining an opening concentric with the firing line, and which bearing support enables rotating a cart when located in the central support position about a vertical axis of the vertical passage of that cart. Thus, a tubular, or tubular string supported by that cart can be rotated while being supported in the firing line. The bearing can be a roller type bearing or any other type of bearing suitable for supporting large loads.

In a further embodiment, the bearing support intersects the two parallel rails, such that the two parallel rails are split into a first and a second set of parallel rails, each for moving one of the two carts between their secondary position and the central support position, in which central support position the carts are located on the bearing support with the firing line passing through the vertical passage. Thus, the part of the cart which contacts the rails is moved onto the bearing support when the cart is moved into the central support position.

In an embodiment, the carts are skid carts and the rails are provided with skid surfaces. In such an embodiment, the cart is provided with a skid surface, or multiple skid surfaces, with which the cart contacts the rails. The skid surface can also be configured as a C-shaped skid surface which C-shape matches the ring shape of the baring support, such that the skid surface of the cart, when located on the ring support is fully supported by the ring support.

In a further embodiment, the rails are wide body rails, or even contact each other such that they form a single skid surface. Such an embodiment provides a larges support surface area for a cart located in its secondary position or being moved between its secondary position and the central support position. A single wide support surface is especially beneficial when the cart is provided with a C-shaped skid surface.

In an alternative embodiment, the carts are rail carts, and are provided with wheels. In such an embodiment, the rails are configured for providing a support surface for rolling wheels.

In an embodiment, the bearing support can be removed from the tubular string support, and the tubular string support furthermore comprises two rail sections that can replace the bearing support when the latter has been removed, bridge the opening between the two sets of parallel rails. Thus, the bearings support can be removed when not needed and be replaced with rail sections to provide the rails with a continuous support surface. This embodiment is especially beneficial when the bearing support intersects the support rails.

It is observed that the ring shaped bearing support defines the maximum dimension of an object to be passed along the firing line through the elongated opening. Furthermore, the ring shaped support prevents a cart form being moved from the central support position into its secondary position, or vice versa, while supporting a tubular. Thus, providing a bearing support that can temporarily be removed allows for passing a larger variety of objects along the firing line, and for suing a cart for supporting a tubular outside the firing line.

In a further embodiment, the bearing support and the carts are provided with couple devices for coupling the carts, when located in the central support position, with the bearing support, and wherein the bearing support is provided with one or more drives for rotating the bearing support and a cart that is coupled therewith. Thus, an optimal rotational support is provided for the cart and, furthermore, the bearing support is used actively turning the cart about a vertical axis. Since the bearing is located below the cart, the drive for rotating the bearing can also be provided below the cart, such that no deck space directly above or adjacent the cart has to be used for mounting a drive to rotate the cart and the bearing.

In a further embodiment, the tubular string support further comprises a diverter, located concentric with the firing line. In an embodiment, beams that form the rails for supporting the cart, or that support those rails, are also sued for supporting the diverter. Thus, the diverter can be supported directly below the cart supported by the beams, which allows for a compact configuration of the tubular string support with diverter.

In a preferred embodiment, the a bearing support is provided on top of the diverter, for enabling rotating a cart when located in the central support position about a vertical axis of the vertical passage of that cart. Thus, the carts can be rotatably supported directly above the diverter, which allows for a compact configuration of the tubular string support with diverter.

In an embodiment, the tubular string support further comprises a cart transport system, which cart transport system comprises one or more transport devices, such as a hydraulic cylinder or a looped chain or wire, for moving the carts between their secondary position and the support position. Thus, there is no need for additional, for example deck mounted transporter devices for moving the carts. Preferably, the transport system is provided below the deck surface of the deck in which the elongate opening is provided, and below the top surface of the carts, which carts in a further embodiment are provided with a deck surface that is substantially flush with the deck surface of the deck in which the elongated opening is provided.

In a preferred embodiment, the cart transport system is provided with a transport device on opposite sides of the elongated opening, such that a cart is moved by at least two transport devices when being transported between the central support position and its secondary position. Thus, the transport devices can be provided alongside the track, which allows for a compact configuration. Furthermore, by engaging both sides of the cart with transport devices, uncontrolled pivoting of the cart about a vertical axis during transport can be avoided, which reduces the need for lateral support of the carts and thus further contribute to a compact configuration of the overall tubular string support.

In an embodiment, the transport system further comprises a yoke for each cart, the yoke is provided with coupling means for being coupled to the one or more transport devices. The yoke thus forms an interface between the transport devices and the cart, and is for example used for coupling the transport devices with the cart, but can also be sued as a guiding device, for example by skidding along the walls of a sloth shaped recess in which the carts are provided, during transport between the secondary position and the centrals support position.

Preferably at least the hanger body of the cart is rotatably supported in the yoke such that at least the hanger body of the cart can be rotated, relative to the yoke, about a vertical axis of the vertical passage of that hanger body.

In an embodiment, the transport devices each comprise a chain or wire, the chains or wires extending on opposite sides of the elongated opening and substantially parallel to the rails of the tubular string support system, and at least one drive for pulling the chains or wires along the rails, and wherein each yoke and/or each cart is provided with a couple device for coupling the yoke and/or the cart with the chains or wires of the transport devices of the transport system. Thus, the transport devices can be used for transporting both carts. The cart to be transported is coupled with the transport devices, for example the yoke of the carts can be provided with hooking device for coupling the yokes with a chain of the transport device, the chain extending along the support rails. When the yoke is coupled on opposite sides to the chains of the transport devices, the chains can be pulled along the rails to move the yoke and thus the cart. When a cart is thus moved into its secondary position, the yoke can be uncoupled from the transport devices, and the yoke of the other cart can be coupled with the transport devices to enable the other cart to be moved into the central support position.

In a preferred embodiment, the wires or chains are looped around driven sprockets, wheels, winches, or similar located at the ends of the rails. In such a configuration, actuating the sprocket, wheel or winch causes a section of the chain to move along the rail in a first direction, and a section of the chain to move along the rail in the opposite direction. Thus, there is no need for adjusting the direction of rotation of the driven sprocket, wheel or winch depending on the intended direction of travel of the cart.

In an alternative embodiment, the transport system comprises transport devices on opposite sides of the firing line, and the transport devices each comprise a cylinder. The cylinders extend on opposite sides of the elongated opening and substantially parallel to the rails of the tubular string support system. In a further embodiment, each cylinder is coupled with one end to the yoke of one of the two carts and with an opposite end to the yoke of the other of the two carts. Each yoke and/or each cart is furthermore provided with a couple device for coupling the yoke and/or the cart to a frame of the transport system to secure the cart in the secondary position.

Since the cylinders are connected with one end to the yoke of one cart and with their opposite end to the yoke of the other cart, the carts can be moved relative to other using the cylinders. Thus, when a first cart is secured in its secondary position, the second cart can be moved relative to the first cart between the central support position and its secondary position. Thus, this embodiment allows for efficient use of cylinders for moving both carts.

In an alternative embodiment, the transport devices each comprise two cylinders, one for each cart, the pairs of cylinders extending on opposite sides of the elongated opening and substantially parallel to the rails of the tubular string support system, and wherein each cylinder is coupled with one end to a frame of the transport system and with an opposite end to a yoke. Thus each cart is provided with a dedicated pair of cylinders, which allows for moving both carts independent of each other and at the same time.

Depending on the transport devices used, the coupling between yoke and the transport devices can be semi permanent. For example, when the same transport devices are used for moving the first cart and the second cart, the couple devices can be coupled with the transport devices only while the cart is being transported moved or the can be uncoupled when the other cart is moved.

In an embodiment, at least one cart is configured for supporting tools for working on a tubular string supported in the firing line, and can move these tools into and out of a working position by moving between the central support position and the secondary position.

In an embodiment, the drilling vessel comprises a drilling deck, which drilling deck has a drilling deck top surface, and the tubular string support structure is recessed in the drilling deck such that it supports the two carts within the drilling deck, just below the drilling deck top surface. In such an embodiment, the carts are supported by the rails such that the top side of the carts is located below the top surface of the deck in which the elongate opening is provided. In a further embodiment, the drilling deck covers the carts when in their secondary position. For example, the drilling deck may comprise a removable deck section, which covers the carts when in their secondary position, and which temporarily be removed to provide access to one or both the cart when in their secondary position.

In an embodiment, the longitudinal opening in which the carts of the tubular string support structure are provided, is provided in a drilling deck. In a further embodiment, a drilling vessel according to the invention furthermore comprises a moonpool with a moonpool deck, and the drilling deck is located above said moonpool deck. In a further embodiment, the moonpool has an elongated shape and the carts, when moved between their secondary position and the central support position, are moved in a direction parallel to a longitudinal axis of the moonpool.

In an embodiment, the longitudinal opening in which the carts of the tubular string support structure are provided, is provided in a drilling deck, and the drilling vessel is provided with tensioners for supporting a tubular casing string, which tensioners are supported by the drilling deck. In a further embodiment, according to the invention, the tubular string support structure further comprises a diverter, which diverter is supported in the firing line, such that a cart located in the firing line is positioned above the diverter.

The invention furthermore provides a method that relates to assembling and lowering a tubular string comprising tubulars with different cross sections, for example lowering a string of casing tubulars into a drilling hole in the sea bottom using a string of drilling tubulars, drilling tubulars typically having a smaller diameter than casing tubulars. The method comprising the steps of:

- Providing a first cart having a clamping device for engaging the tubulars with the wide cross section. Thus, tubulars with a wide cross section can be supported in the vertical passage of the hanger body of the first cart, and thus in the firing line when the cart is positioned in the central support position.
- Providing a second cart having a clamping device for engaging the tubulars with the narrow cross section. Thus, tubulars with a narrow cross section can be supported in the vertical passage of the hanger body of the second cart, and thus in the firing line when the cart is positioned in the central support position.
- Supporting a wide cross section tubular in the firing line using a hoist system of the drilling tower.
- Moving the firs cart into the central support position and clamping a wide cross section tubular in the firing line using the clamping device of the first cart, thus moving the tubular string, supported by the hoist system of the drilling tower, through the lateral passage of the hanger body of the first cart.
- Clamping the wide cross section tubular in the firing line using the clamping device of the first cart, and supporting that tubular in the firing line.
- Uncoupling the tubular string form the hoist system of the drilling tower.
- Attaching another wide cross section tubular to the wide cross section tubular to form a tubular string. Thus, by subsequently combining tubulars, or sub sets of two or three already connected tubulars, to each other a tubular string is assembled.
- Releasing the tubular string with the clamping device of the first cart.
- Lowering the tubular string using a hoist system of the drilling tower.
- Engaging the top end of the tubular string with the clamping device of the first cart and supporting the tubular in the firing line.
- Uncoupling the tubular string form the hoist system of the drilling tower
- Attaching a narrow cross section tubular to the wide cross section tubular of the tubular string supported in the firing line.
- Coupling the tubular string to the hoist system of the drilling tower.
- Releasing the tubular string with the clamping device of the first cart.
- Lowering the tubular string using the hoist system of the drilling tower, and supporting the tubular string in the firing line using the hoist system of the drilling tower.
- Moving the first cart out of the central support position and into its secondary position, thus moving the tubular string, supported by the hoist system of the drilling tower, through the lateral passage of the hanger body of the first cart.
- Moving the second cart from its secondary position into the central support position, thus moving the tubular string, supported by the hoist system of the drilling tower, through the lateral passage of the hanger body of the second cart.
- Engaging the upper end of the tubular string with the clamping device of the second cart and supporting the tubular string in the firing line.
- Uncoupling the tubular string form the hoist system of the drilling tower.
- Attaching another narrow cross section tubular to the tubular string.
- Coupling the tubular string to the hoist system of the drilling tower.
- Releasing the tubular string with the clamping device of the second cart.
- Lowering the tubular string using the hoist system of the drilling tower, and supporting the tubular string in the firing line using the hoist system of the drilling tower.
- Engaging the upper end of the tubular string with the clamping device of the second cart.

With a method according to the invention, two carts are provided. One is used for supporting a section of a tubular string with a wide diameter and the other is used for supporting sections of that tubular string having a narrow diameter. Thus, when there is a change in diameter of the tubulars used for composing the tubular string, the cart in the central support position is simply replaced by the other cart. The time need for providing the dedicated tubular support device is reduced and there is no need for extensive adaptation and or replacement of tools in the firing line. Thus the work in the firing line is not, or only for a reduced amount of time, interrupted.

According to the invention a similar method can be used for assembling or disassembling a string of tubulars comprising tubulars having a first diameter and tubulars having a second diameter, wherein the tubulars having the first diameter alternate with tubulars having the second diameter. Other configurations of tubular strings comprising tubulars with different diameter can also be efficiently assembled or disassembled using a drilling vessel according to the invention.

In a further embodiment according to the invention, instead of a clamping device a supporting device can be used for supporting a tubular by its flange. Typically, such supporting devices are also configured to fit the diameter of the tubular to be supported.

In a further method according to the invention, one cart is provided with a clamping device for engaging the circumferential surface of a tubular body, and the other cart is provided with a supporting device for supporting a tubulars by there flange. For example tubulars for composing a riser string are typically provided with bouncy means on there circumferential surface, and are therefore preferably supported by their flanges.

In an embodiment, the tubular string support structure is furthermore configured for supporting at least one auxiliary device, for example a diverter and/or a bearing support, at the central support position, such that the auxiliary device is supported below a cart located in the central support position, and which at least one auxiliary device preferably can be lowered into said position and can be lifted out of said position when the carts are both in their secondary position.

In a preferred embodiment, the tubular string support comprises a frame, the frame connecting, and in use supporting, at least the two parallel rails such that the tubular string support. In a further embodiment, the frame may also connect, and in use support, a bearing support and/or a cart transport system. Thus, by providing a frame that connects several components of the tubular strong support and in use supports those components and the carts, the invention provides a module for retrofitting in existing drilling vessels to provide a drilling vessel according to the invention. The modular configuration facilitates installing, and may be fitted such that it can later be easily removed for example for maintenance.

According to a second aspect the invention furthermore provides a drilling vessel having a firing line, along which a tubular string is passed into the sea during drilling activities, the firing line extending in a substantially vertical direction, and a tubular string support structure. According to the second aspect of the invention, the tubular string support structure comprises a cart that can be moved into and out of a position in the firing line, and a support bearing for supporting the cart in its position in the firing line and enabling rotation of the cart about a vertical axis of its vertical passage, the vertical axis coinciding with the firing line.

The drilling vessel according to the second aspect of the invention comprises:

A drilling tower having a firing line, along which a tubular string is passed into the sea during drilling activities, the firing line extending in a substantially vertical direction, and;

A tubular string support structure, the support structure comprising:

a bearing support, the bearing support defining an opening concentric with the firing line.

at least one cart, the cart having a hanger body that defines a vertical passage adapted to receive a tubular string supported in the firing line, and which hanger body defines a lateral passage, in communication with said vertical passage, allowing to place the tubular string in and remove the tubular string from said vertical passage;

two parallel rails, which rails are provided to support the cart such that it can be moved between a central support position, on the bearing with the firing line passing through the vertical passage, and a secondary position on the rails with the firing line passing outside the vertical passage, and wherein the bearing support enables rotating said cart when in the central support position about a vertical axis of the vertical passage of said cart.

With a drilling vessel according to a second aspect of the invention, a cart is provided which can be moved in a central support position for supporting tools and/or a tubular or tubular string located in the firing line. The tubular string support structure is provided with a bearing support, the bearing support defining an opening concentric with the firing line. The bearing support enables rotating said cart when in the central support position about a vertical axis of the vertical passage of said cart. Thus, tools mounted on the cart and/or a tubular supported by the cart can be rotated about the central axis of the firing line, and thus be positioned relative to for example another tubular or other tools already located in the firing line.

In an embodiment, the cart thus provides a movable platform for bringing tools into and out of the firing line, and positioning these tools relative to the firing line by rotating them about the firing line. In another embodiment, the cart provides a removable support for tubulars located in the firing line, which in combination with the bearing support enables rotating a tubular or tubular string in the firing line. In a third embodiment, the cart is adapted for supporting tools as well as tubulars. In a further embodiment, the cart also forms a deck section.

The drilling vessel according to the second aspect of the invention thus differs form a drilling vessel according to the first aspect of the invention in that the tubular string support structure may comprise a single cart instead of two carts located in opposite sides of the firing line. However, all features, and related benefits, described with respect to a tubular string support structure according to the first and/or third aspect of the invention, can be combined with the tubular string support according to the second aspect of the invention.

According to a third aspect, the invention furthermore provides a drilling vessel having a firing line, along which a tubular string is passed into the sea during drilling activities, the firing line extending in a substantially vertical direction, and a tubular string support structure. According to the third aspect of the invention, the tubular string support structure comprises a cart transport system configured for moving the at least one cart between its support position in the firing line, and its secondary position outside the firing line.

A drilling vessel according to the second aspect of the invention comprises:

a drilling tower having a firing line, along which a tubular string is passed into the sea during drilling activities, the firing line extending in a substantially vertical direction, and;

a tubular string support structure, the support structure comprising:

Two parallel rails, which rails are provided on opposite sides of an elongated opening, wherein the firing line passes through said elongated opening between the rails; and at least one cart, the cart having a hanger body that defines a vertical passage adapted to receive a tubular string supported in the firing line, and which cart is supported by the parallel rails such that the cart can be moved between a support position, above the elongated opening with the firing line passing through the vertical passage, and a secondary position with the firing line passing outside the vertical passage, and a cart transport system, configured for moving the at least one cart along the two parallel rails between the support position and the secondary position.

The drilling vessel according to the third aspect of the invention thus differs form a drilling vessel according to the first aspect of the invention in that the tubular string support structure may comprise a single cart instead of two carts located in opposite sides of the firing line. However, all features, and related benefits, described with respect to a tubular string support structure according to the first and/or second aspect of the invention, can be combined with the tubular string support according to the third aspect of the invention.

Further objects, embodiments and elaborations of the apparatus and the method according to the invention will be apparent from the following description, in which the invention is further illustrated and elucidated on the basis of a number of exemplary embodiments, with reference to the drawings.

DETAILED DESCRIPTION

Figure 1:
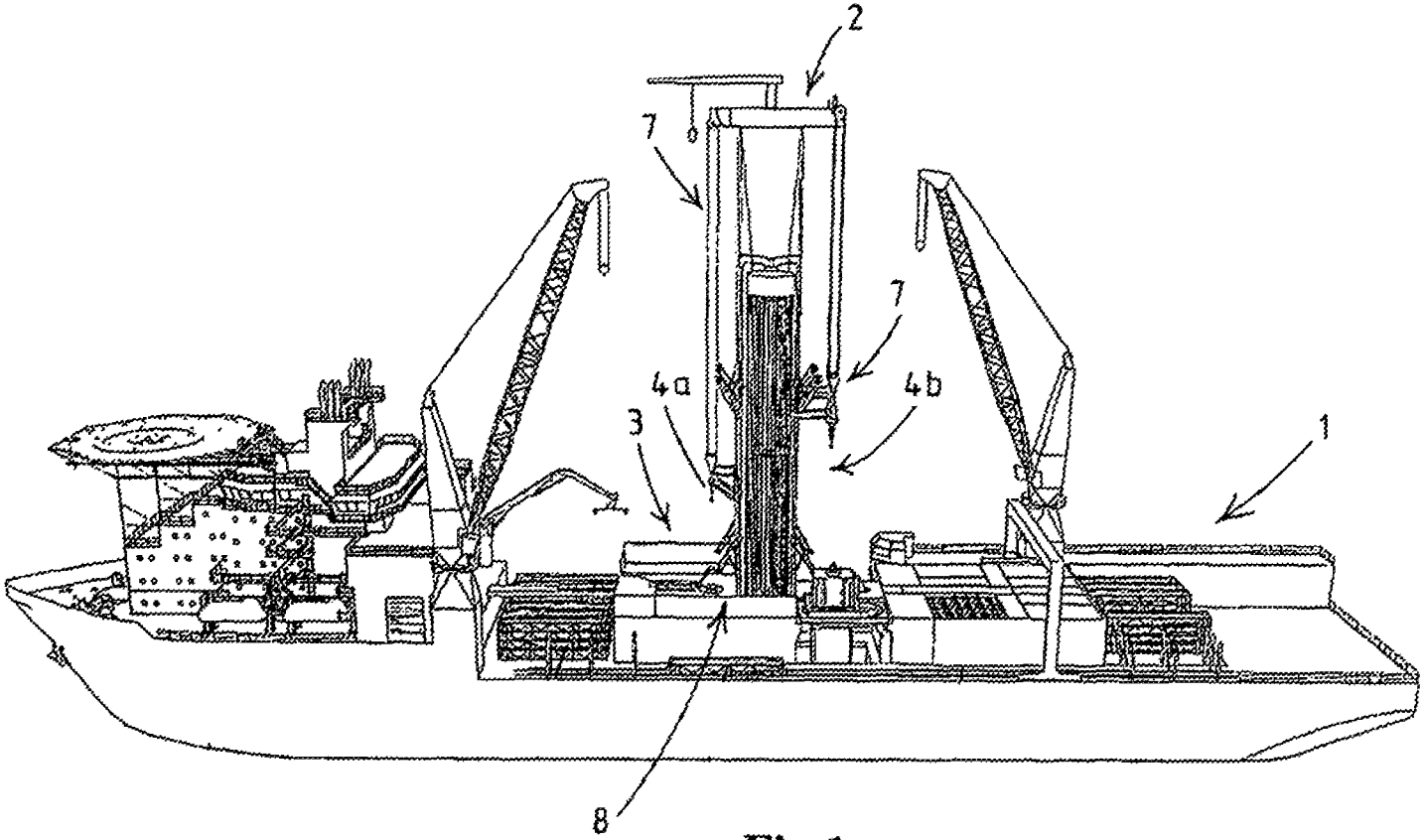
FIG. 1 shows a drilling vessel according to the invention in perspective view.

FIG. 1 shows a drilling vessel 1 according to the invention in perspective view. The drilling vessel shown comprises a drilling tower 2. The drilling tower is of the mast type and comprises two firing lines 4, both on the outside of the mast. One of the firing lines 4*a* is located on the side of the mast type drilling tower that faces the front of the drilling vessel, and one of the firing lines 4*b* is provided on the side of the mast type drilling tower that faces the rear of the drilling vessel. At both sides, the mast type drilling tower is provided with a hoisting device 7, comprising a trolley that can be moved downward and upward along tracks mounted on the outside of the mast, to support, lower and lift tubulars in the firing line. These types of hoisting devices are generally known and therefore not discussed in detail herein.

Figure 2:
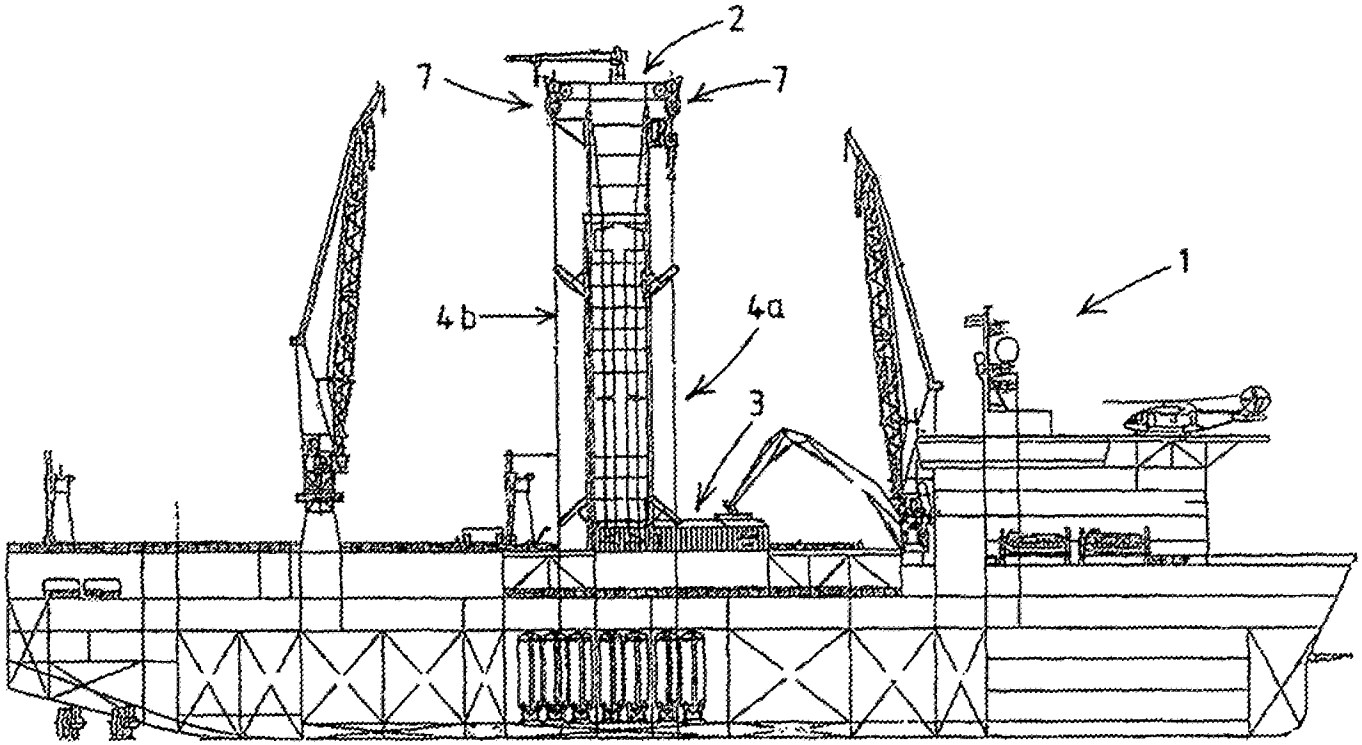
FIG. 2 shows the drilling vessel of FIG. 1 in partial cross section.

The drilling vessel 1 is provided with a tubular support structure 3 according to the invention, which tubular support structure is located a deck level and in on the front side of the mast type drilling vessel. FIG. 2 shows the drilling vessel of FIG. 1 in partial cross section.

It is observed that the FIGS. 1 and 2 are schematic representations of a vessel according the invention and only serve to depict the location of a tubular support structure 3 on the vessel 1. The tubular support structure 3 itself is shown in FIGS. 3 and 4.

Figure 3:
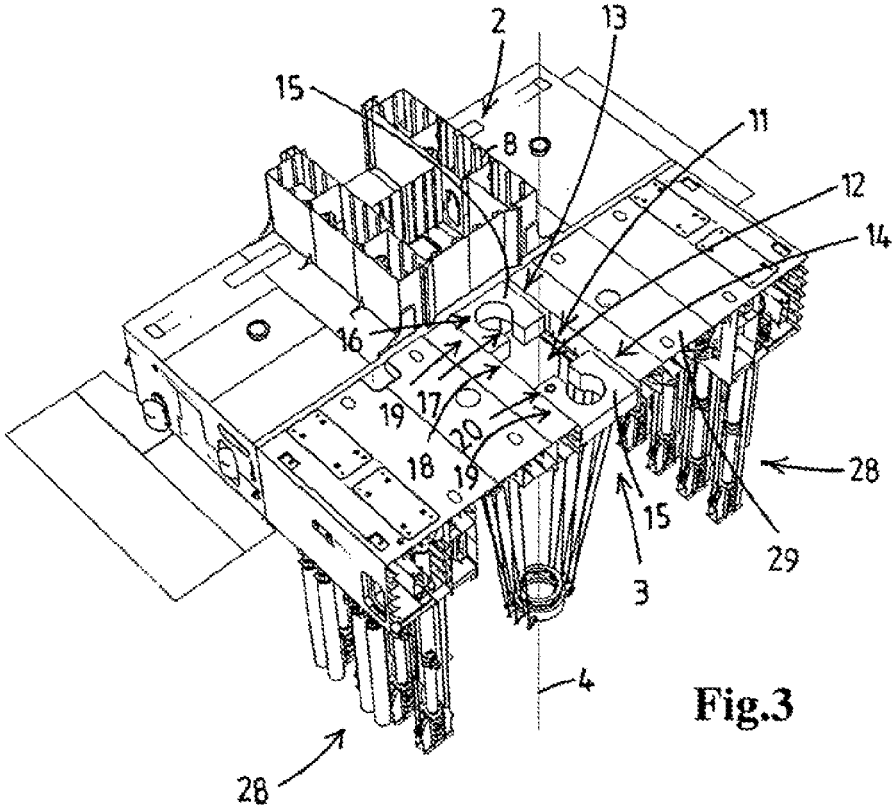
FIG. 3 shows in perspective view from above a section of the drilling vessel of FIG. 1 provided with a tubular support structure according to the invention.
Figure 4:
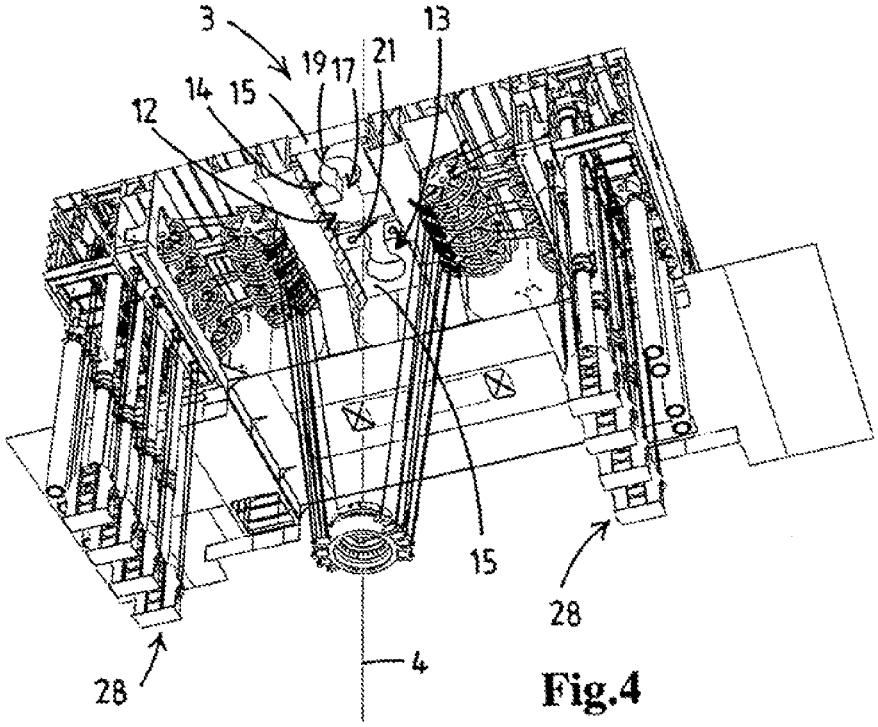
FIG. 4 shows the section of FIG. 3 in perspective view from below.

FIG. 3 shows in perspective view from above a section of the drilling vessel 1 of FIG. 1 provided with the tubular support structure 3 according to the invention. FIG. 4 shows the same section of FIG. 3 but now in perspective view from below.

The section shown comprises the base 8 of the mast like drilling tower 2, and a section of a drilling deck 29 in which the tubular support structure 3 is provided. In the embodiment shown, the drilling deck 29 is located in front of the mast like drilling tower, and extends alongside the drilling tower to the back of the drilling tower.

The tubular support structure 3 is provided in front of the tower and above a moonpool in the hull of the drilling vessel. The firing line 4*a* of the drilling tower 2 extends in a substantially vertical direction and passes via the tubular support structure 3 into the moonpool of the drilling vessel 1. Thus, using the hoisting device 7 of the drilling tower, a tubular string can be passed along the firing line 4*a* into the sea during drilling activities, and, using the tubular support string structure 3 a tubular or tubular string can be supported in the firing line 4*a*.

The tubular string support structure comprises two carts 13,14, each comprising a hanger body 14,15. Both carts are supported on a set of parallel rails 11 extending on opposite sides of an elongated opening 12. In FIGS. 3 and 4 the carts are each located in a secondary position, or parking position, on opposite sides of a central support position 18. The firing line 4*a* passes through the central support position and elongated opening 12 between the rails 11.

When both carts are positioned in their secondary position, between the carts there is provided a passage for passing through large objects along the firing line.

The hanger bodies of the two carts 13,14 each define a vertical passage 16 adapted to receive a tubular string supported in the firing line 4*a*, and each define a lateral passage 17, in communication with said vertical passage, allowing to place the tubular string in and remove the tubular string from said vertical passage.

According to the invention, the carts 13,14 of the tubular support structure 3 are configured for supporting a tubular in the firing line 4*a*. When the carts 13,14 are positioned in the central support position 18, their vertical passages 16 are aligned with the firing line 4*a*, such that a tubular supported in the firing line is located in the vertical passage 16 of the hanger body, and can be engaged by the hanger body, for example by way of clamps that engage the tubular in a radial direction and/or by providing a support surface adjacent the tubular to support a flange of the tubular.

The carts 13,14 are each supported by the parallel rails 11 such that each cart can be moved between the central support position 18, in which a cart is positioned above the elongated opening with the firing line passing through its vertical passage, and the secondary position 19, in which a cart is located above the elongated opening with the firing line passing outside the vertical passage. The lateral passage 17 of the hanger body allows for the carts to be moved into and out of the central support position while a tubular, or tubular string, is supported in the firing line. In such a case, the tubular enters the vertical passage of the hanger body via the lateral passage.

The drilling vessel shown in FIGS. 1 and 2 the tubular string support structure 3 is recessed in the drilling deck 29, such that it supports the two carts 13,14 in the drilling deck 29, substantially below the top surface of the drilling deck. The carts 13,14 are supported by the rails 11 such that the top side of the carts is located substantially level with the top surface of the deck in which the elongate opening is provided.

In an alternative embodiment, the carts are supported by the rails such that the top side of the carts is located below the top surface of the deck in which the elongate opening is provided. In a further embodiment, the drilling deck covers the carts when in their secondary position. For example, the drilling deck may comprise a removable deck section, which covers the carts when in their secondary position, and which temporarily be removed to provide access to one or both the cart when in their secondary position.

In the embodiment shown the carts 13,14 each are provided with a substantially flat top surface that functions as a deck. The carts thus each form a slideable deck section, which deck sections are part of the drilling deck of the drilling vessel.

The moonpool of the drilling vessel 1, not shown in the figures, extends in a longitudinal direction of the vessel. The drilling deck, in which the tubular support section has been provided, is located above the moonpool, and the carts, when moved between their secondary position and the central support position, are moved in a direction parallel to a longitudinal axis of the moonpool.

Furthermore, in the embodiment shown, the drilling vessel 1 is provided with tensioners 28 for supporting a tubular casing string, which tensioners are supported by the drilling deck 29. Thus a casing string can be built in the firing line, using the tubular support structure 3 according to the invention, and subsequently be lowered into a support ring of the riser tensioner device, for example to support a casing string that is connected to a well head in de sea floor.

Figure 5B:
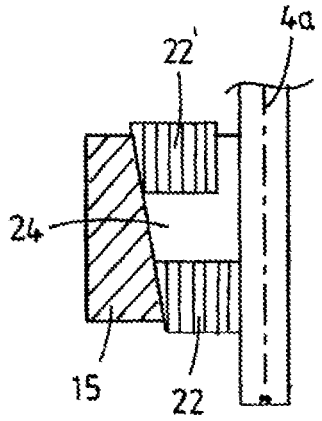
FIG. 5B shows part of the cart of FIG. 5*a* in cross section, with the clamping block shown in its top as well as in its bottom clamping position.
Figure 6B:
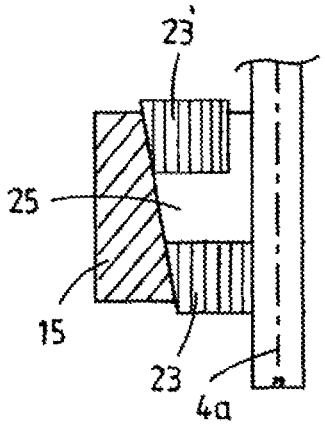
FIG. 6B shows part of the cart of FIG. 6*a* in cross section, with the clamping block shown in its top as well as in its bottom clamping position.
Figure 5A:
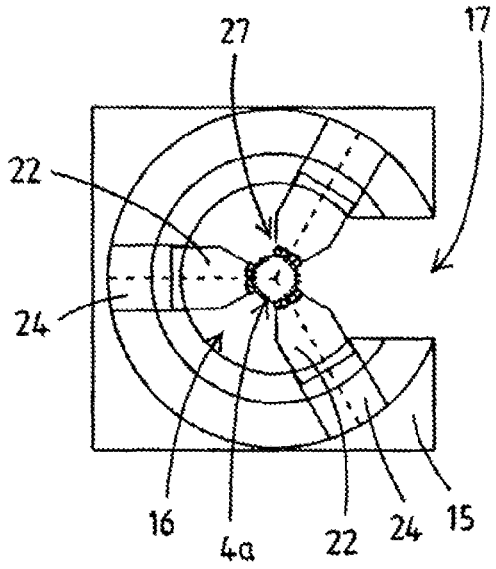
FIG. 5A shows in top view an embodiment of a cart according to the invention, the cart being provided with three clamping blocks.
Figure 6A:
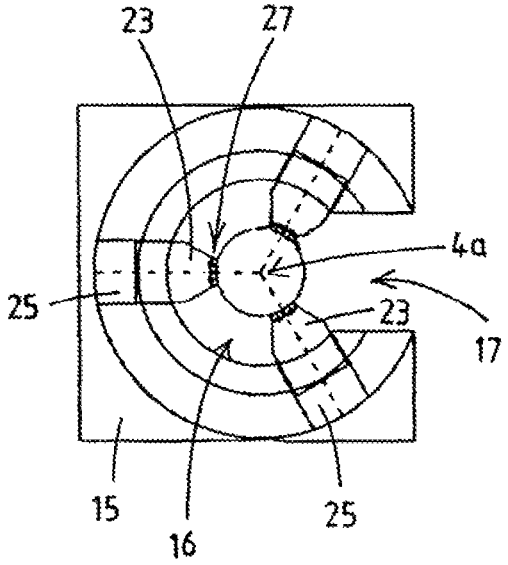
FIG. 6A shows in top view alternative embodiment of a cart according to the invention, the cart being provided with three clamping blocks.

FIGS. 5 and 6 schematically show, in top view and in a sectional cross section, a cart, similar to the one shown in FIGS. 3 and 4, in more detail. The carts shown each comprise a hanger body 15 provided with multiple actuable, preferably hydraulically actuable, support devices. In the embodiment shown, the support devices are provided in the form of moveable clamping blocks 22,23, which can be moved into and out of the vertical passage for engaging and releasing respectively a tubular in said vertical passage. In the embodiment shown, the clamping blocks 22,23 are provided with pads 26, 27, shown in FIGS. 5*a* and 6*a*, for contacting a tubular to be engaged in the vertical passage of the hanger body. The actuators for moving the blocks are not shown in the figures.

In the particular embodiments shown, the clamping blocks 22,23 are supported in a vertical guide 24,25. More in particular, the clamping blocks 22,23 are, with a slanted contact surface, supported on a slanted contact surface of the vertical guides such that, by moving the clamping blocks along the slanted guide surface, the substantially vertical contact surface of the clamping blocks, in the embodiment shown provided with the pads 26,27, is moved vertically as well as in the radial direction towards or away from the firing line. Thus, when the clamping blocks engage a tubular in the vertical passage, the weight of the tubular pulls the clamping blocs in a downward direction, which, due to the slanted surfaces of clamping blocks and guide, forces the clamping blocks inward and thus enhance the grip of the clamping blocks on the tubular. It is observed that the use of slanted surfaces to enhance the grip is typically used with slips and similar gripping devices.

FIGS. 5*a* and 6*a* show the clamping blocks 22,23 in an extend position, engaging a tubular 9,10 located in the firing line 4. FIGS. 5*b* and 6*b* depict the carts in cross section, with the clamping blocks 22',23' depicted in a lifted passive position and with the clamping blocks 22,23 in a lowered and active position. In the lowered active position, the clamping blocks extend in the vertical passage of the hanger body for engaging and supporting a tubular. In their retracted passive position the clamping blocks are moved in the radially outward direction, which allows for passing a tubular through the vertical passage of the hanger body in a vertical direction and/or into and out of the vertical passage via the lateral passage.

The wedge shape of the clamping blocks and the slanted interface surfaces of the hanger body and the clamping blocks, provide support devices that can be extended into a range of active positions, such that the active position of the support devices can be adapted to fit the diameter of a tubular in the vertical passage, and the hanger body can thus be used with a range of tubulars.

The clamping blocks 22 of the cart shown in FIG. 5*a* are dimensioned for engaging a tubular 9 with a first diameter, and the clamping blocks 23 of the cart shown in FIG. 6*a* are configured for engaging tubulars 10 with a second diameter, the second diameter being wider than the first diameter. In an embodiment a tubular support structure according to the invention comprises a first cart similar to the one shown in FIG. 5 and a second cart similar to the one shown in FIG. 6. Thus the tubular support structure is configured for supporting tubulars having a first diameter and for supporting tubulars having a second diameter.

Furthermore, the clamping blocks 22 of the cart shown in FIG. 5*a* are configured for handling a first range of tubulars, in the embodiment shown are dimensioned for handling tubulars having a diameter within a first range. The clamping blocks 23 of the cart shown in FIG. 6*a* are configured for handling a second range of tubulars, in the embodiment shown are dimensioned for handling tubulars having a diameter with in second range. In the embodiment shown, the second range partially overlaps with the first range.

The carts of a tubular support structure shown are thus configured for engaging different types of tubulars, in the embodiment shown tubulars that differ in diameter. Thus, when the type of tubular to be supported in the firing line changes, for example when in the firing line a tubular string is built of tubulars having a different diameter, the cart in the central support position can be replaced with the other cart to thus adapt the tubular support structure to a change in the type of tubular to be supported.

FIGS. 7-12 show a section of a drilling vessel 1 similar to the one shown in FIGS. 1 and 2, provided with an alternative tubular support structure 50 according to the invention. FIG.

Figure 11:
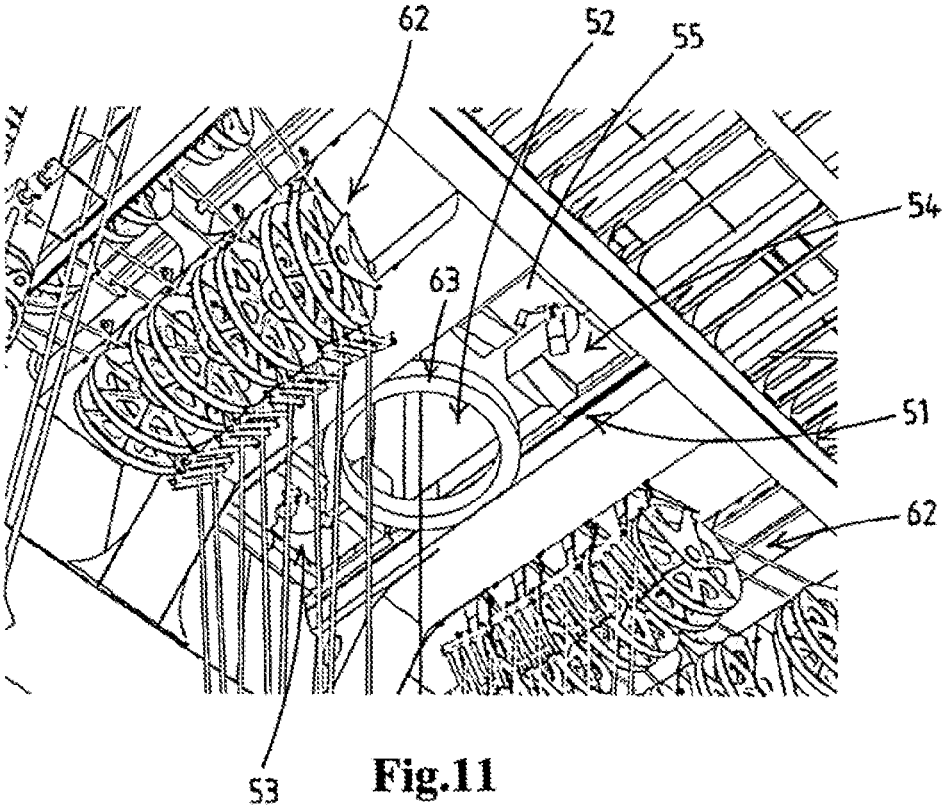
FIG. 11 shows the section of the drilling vessel of FIG. 7 in perspective view from below, showing a support bearing and both carts in their secondary position.
Figure 12:
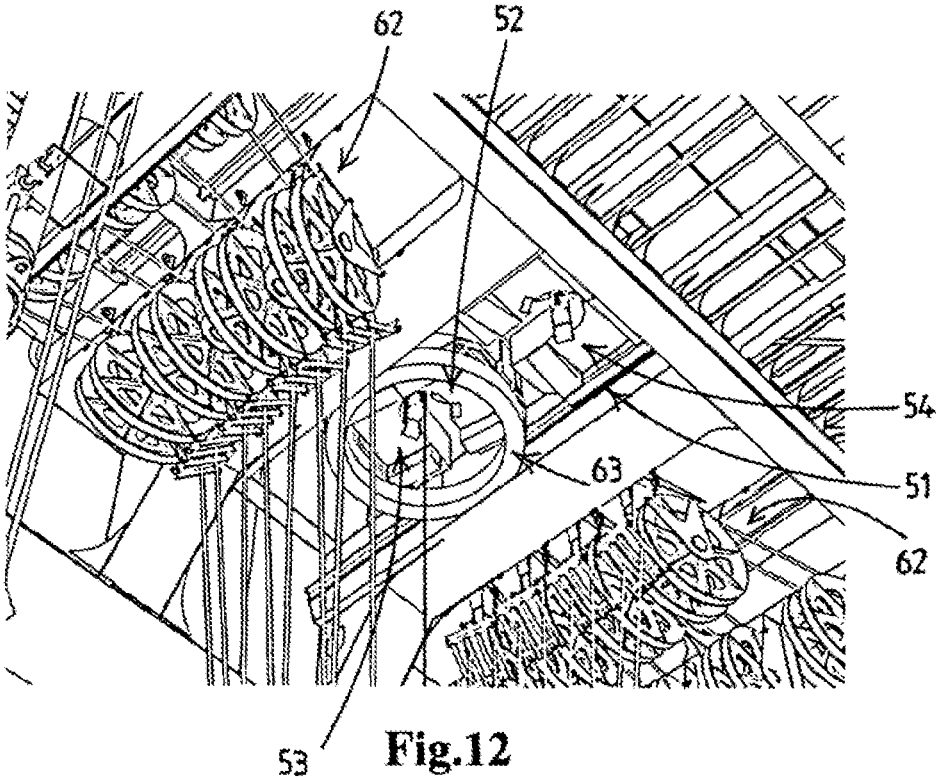
FIG. 12 shows the section of the drilling vessel of FIG. 7 in perspective view from below, showing a support bearing, one cart in its central support position and one cart in is secondary position.

7-10 shows a perspective view from above of the section of a drilling vessel and the tubular support structure 50 according to the invention, and FIGS. 11 and 12, show a perspective view from below of the section of a drilling vessel and the tubular support structure 50.

According to the invention the tubular string support structure comprises a first cart 53 and a second cart 54, which are supported on parallel rails 51 above an opening 52 in the deck. Similar to the tubular support structure shown FIGS. 4 and 5 the carts are supported in a recess in the deck. The two carts 53,54 are supported by the rails 51 such that the top side of the carts is located below the top surface of the deck in which the elongate opening is provided. The deck 29 comprises deck sections provided on opposite sides of the central support position 58, which deck sections cover the carts when in their secondary position, and which can temporarily be removed to provide access to one or both the cart when in their secondary position 59. In the figures these deck sections have not been depicted to show the carts in their secondary positions.

Similar to the carts shown in the preceding figures, both carts 53,54 comprise a hanger body 55 provided with a vertical passage 56 and a lateral passage 57. The hanger bodies are provided with clamping bodies 60, similar to the one shown in FIGS. 5 and 6, which are provided in a vertical guide 61.

The tubular support structure 50 shown in FIGS. 7-12 differs from the tubular support structure shown in the preceding figures in that it is provided with support bearing 63 for supporting the hanger bodies 55 in the central position, which support bearing is provided concentric with the firing line. In the embodiment shown, the support surface of the support bearing 63 overlaps with the rails, thus effectively dividing the parallel rails 51 in two subset of rails, one set for supporting the first cart and another set for supporting the other cart. Furthermore, in the embedment shown, the support bearing 63 is provided with rails sections, which support the cart when located in the central support position. In an alternative embodiment, the support bearing is provided with a ring shaped support surface.

Similar to the carts of the tubular support structure shown in the FIGS. 3-6, the vertical passage of the carts 53,54 has a central vertical axis that coincides with the firing line when the cart is located in the central support position. In addition, the carts 53,54 of the tubular support structure shown in FIGS. 7-12 can be rotated about that central vertical axis when the carts are located in the central support position. Thus, a tubular or tubular string supported by the cart can be rotated about its longitudinal axis.

Figure 8:
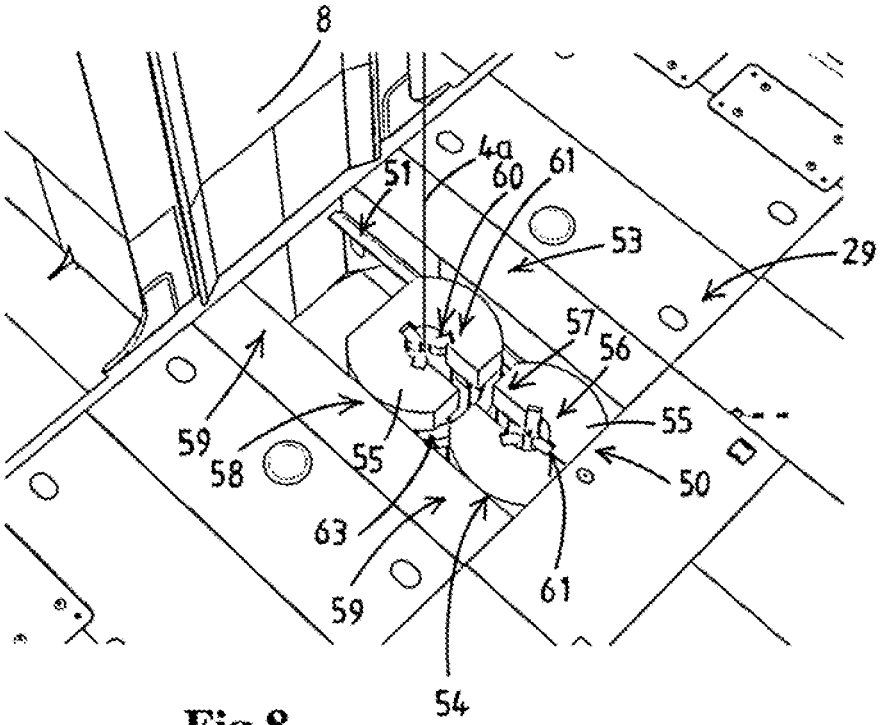
FIG. 8 shows the section of the drilling vessel of FIG. 7, with one cart moved from its secondary position into a central support position.

FIG. 8 shows the tubular support structure 50 with the first cart 53 moved from its secondary position into the central support position on top of the bearing support, such that a tubular supported by the cart can be rotated about its longitudinal axis. It is observed that in the figures the tubulars are not depicted.

The hanger bodies 55 differ from the ones shown in the preceding figures in that they are provided with rounded sides. The hanger bodies are provided with semi-circular sides to enable rotating the hanger bodies while being located in a recess in the deck. Furthermore, the hanger bodies are provided with straight sides, such that when in they are positioned in their secondary position with their lateral opening facing the firing line, they provide an extra wide opening between the carts.

Figure 9:
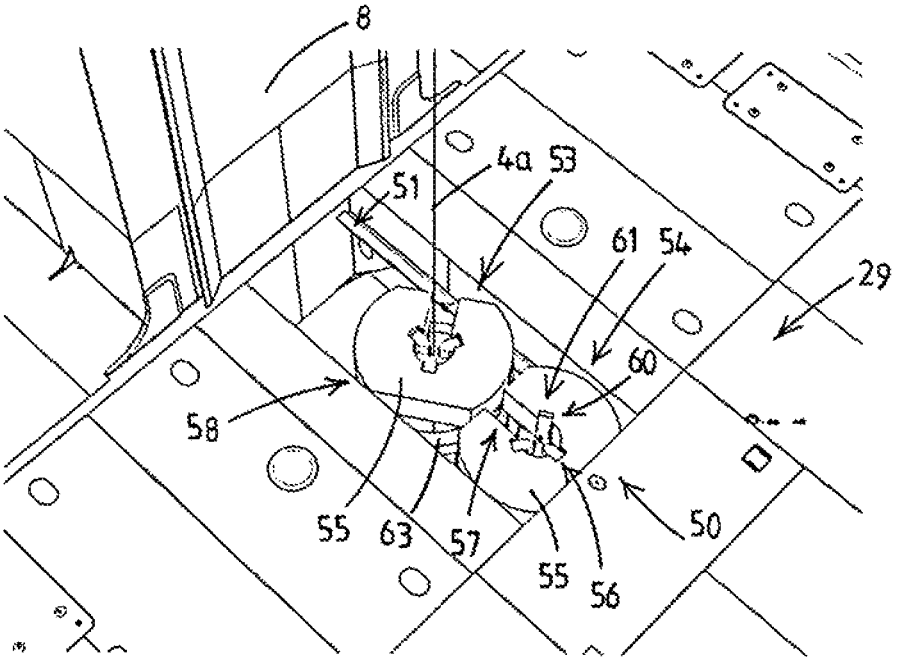
FIG. 9 shows the section of the drilling vessel of FIG. 8, with the cart in the central support position rotated about the firing line.
Figure 10:
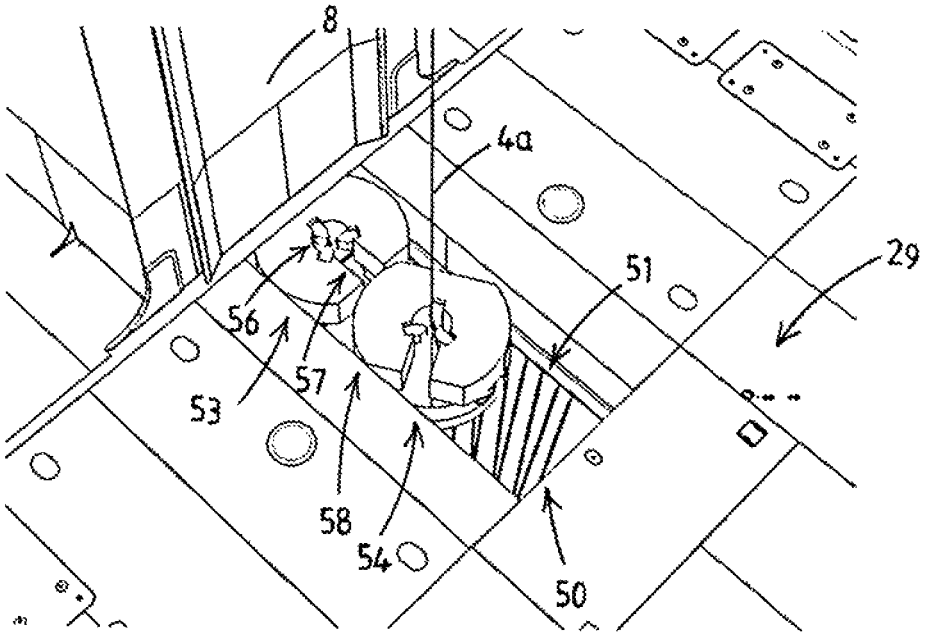
FIG. 10 shows the section of the drilling vessel FIG. 7 with the other cart located in the central support position and rotated about the firing line.

FIG. 9 the tubular support structure with the first cart rotated about a vertical axis central to its vertical passage and coinciding with the firing line. FIG. 10 shows the tubular support structure 50 with the first cart in its secondary position and the second cart 54 located in the central support position and rotated about the firing line.

Figure 7:
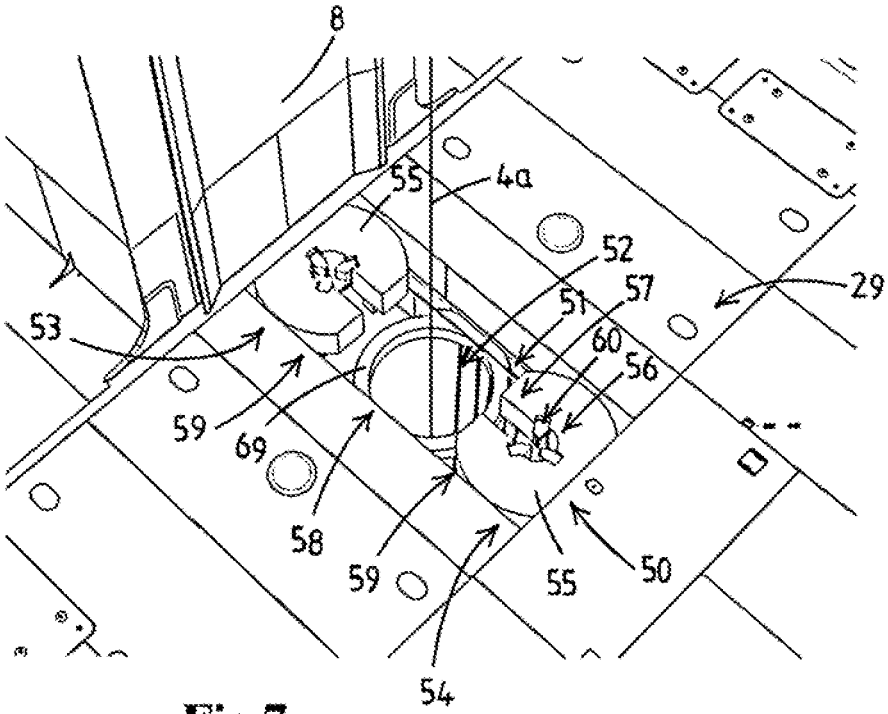
FIG. 7 shows in perspective view from above a section of a drilling vessel of FIG. 1 provided with a tubular support structure according to the invention, the tubular support section comprising two carts which are both depicted in their secondary position.

FIG. 11 shows the tubular support structure 50 of FIG. 7 in perspective view from below, with both carts in their secondary position, similar to the situation in FIG. 7. FIG. 12 shows the tubular support structure 50 of FIG. 7 in perspective view from below, with both carts 53,54 in their secondary position, similar to the situation in FIG. 7.

FIG. 12 shows the section of the drilling vessel of FIG. 7 in perspective view from below, with the first cart 53 located on the support bearing 63 and the second cart 54 located in its secondary position, similar to the situation shown in FIG. 9.

In the embodiment shown in FIGS. 7-12, the elongated opening is provided in a drilling deck 64 which drilling deck also supports the riser tensioners 62. In the embodiment shown, the riser tensioner system comprises multiple cylinders and guide wheels, which are all supported by the drilling deck.

Figure 13:
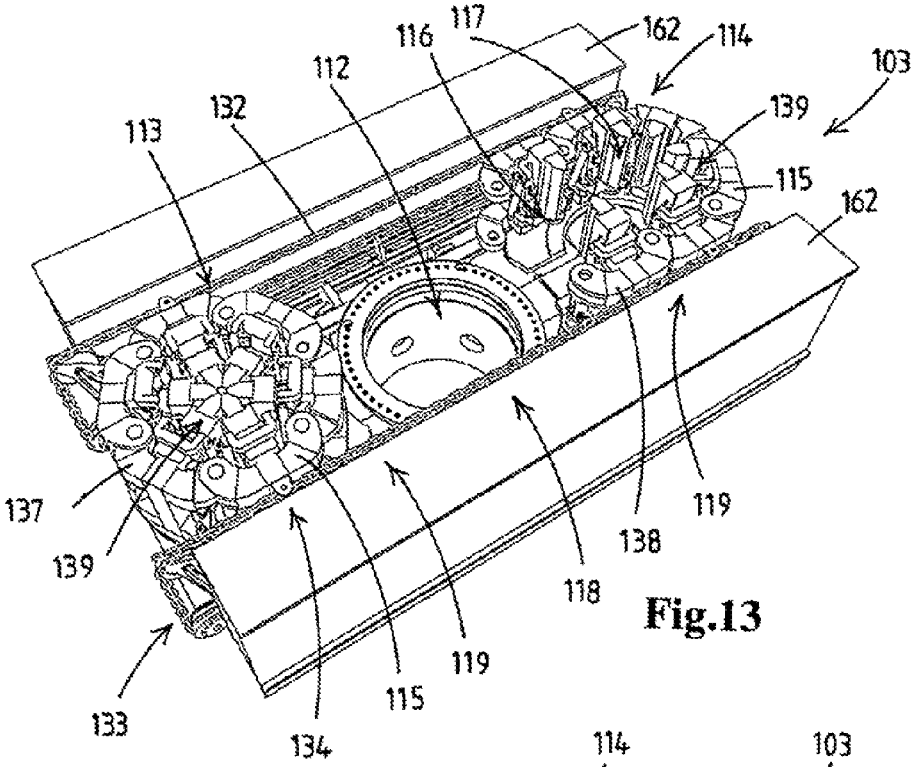
FIG. 13 shows a perspective view of an alternative tubular support structure comprising a cart transport system according to the invention, the tubular support structure being provided in a modular design to be fit in a vessel similar to the tubular support structure shown in FIG. 7-12.

FIG. 13 shows a perspective view of an alternative tubular support structure 103 comprising a cart transport system 131 according to the invention. The tubular support structure 103 is depicted without the vessel. In practice it will be mounted in a drilling vessel adjacent the drilling tower, preferably a mast type drilling tower, such that the firing line of the drilling tower passes through the tubular support system as has been discussed with respect to the other embodiments disclosed herein.

The tubular string support structure 103 is configured similar to the ones disclosed in FIGS. 7-12. The tubular support structure comprises two parallel rails 111, which rails are provided on opposite sides of an opening 112 through which, when the tubular string support structure is mounted in a vessel, the firing line passes. The tubular support structure further comprises two carts 113,114. Each cart has a hanger body 115. The hanger bodies 115 each define a vertical passage 116 adapted to receive a tubular string supported in the firing line, and which hanger body defines a lateral passage 117, in communication with said vertical passage, allowing to place the tubular string in and remove the tubular string from said vertical passage.

The carts 113,114 are each supported by the parallel rails 111 such that each cart can be moved between a central support position 118 with the firing line passing through the vertical passage, and a secondary position on opposite sides and adjacent to the central support position with the firing line passing outside the vertical passage.

In the embodiment shown, the tubular string support 103 is further provided with bearing support 163 according to the invention, the bearing support defining an opening concentric with the firing line, for rotatable supporting a cart located in the central support position.

Furthermore, the tubular string support 103 comprises a diverter 130, located such that it is concentric with the bearing support 103 and, when the tubular support structure is mounted in a drilling vessel, concentric with the firing line. The bearing support 103 is provided on top of the diverter 130, to enable rotating a cart located in the central support position, the cart for example supporting a drill string, about a vertical axis of the vertical passage of the hanger body of that cart.

The bearing support 103 and the carts 113,114 are provided with couple devices, in the embodiment shown openings for receiving bolts, to couple the carts, when located in the central support position, with the bearing support. Thus, the bearing support enables rotating the cart, and also secures the cart in the central support position while it is being rotated. It is observed that other connecting devices, such as hydraulically actuated clamps or pins, can also be sued for coupling a cart with a bearing support according to the invention.

In the embodiment shown, the bearing support 103 is furthermore provided with drives for rotating the bearing support and a cart that is coupled therewith. In the embodiment shown, the bearing is provided with a circumferential contact surface for engagement with an electric drive. In alternative embodiments, other types of drives can be used for rotating the bearing and the cart provided thereupon.

The tubular support structure 103 further comprises a frame of which two frame elements 162 extend on opposite sides of the tubular support structure. The frame connects the different components of the tubular support structure 103, in the embodiment shown, the rails 111 and transport system 131. The frame furthermore provides a seat for the diverter and the bearing support, such that these can be mounted to the frame and secured relative to the rails and transport system of the tubular support system. In the embodiment shown, the bearing support and the diverter can be removed from the tubular string support and replaced with rail sections, to enable use of the tubular support structure without the bearing support and the diverter.

By providing a frame that connects the main components of the tubular support structure, the tubular support structure is configured as a unit or module, that can be mounted in a drilling vessel, for example as shown in FIG. 7-12. Providing the tubular support structure with such a frame and thus a modular design, facilitates installing, and optionally removing, the tubular support structure in and from a drilling vessel.

Figure 14:
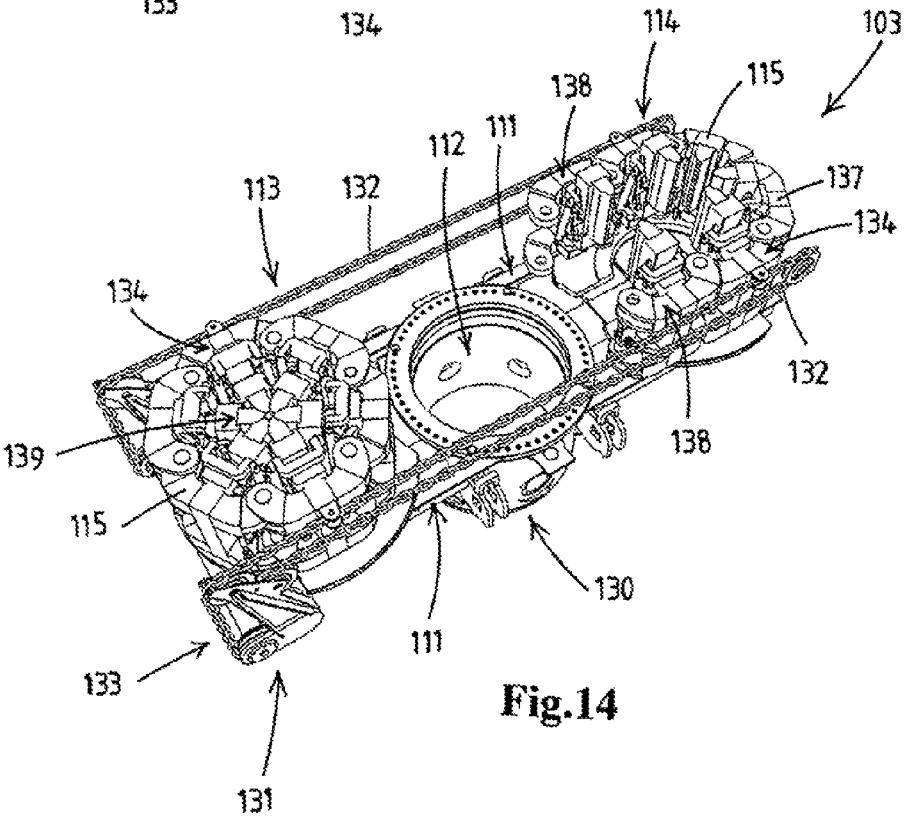
FIG. 14 shows part of the tubular support structure of FIG. 13.

FIG. 14 shows part the tubular support structure 103 of FIG. 13 without the two frame elements 162 provided on opposite sides of the tubular support structure. Thus, in FIG. 14 part of the cart transport system 131 according to the invention is visible.

Figure 16:
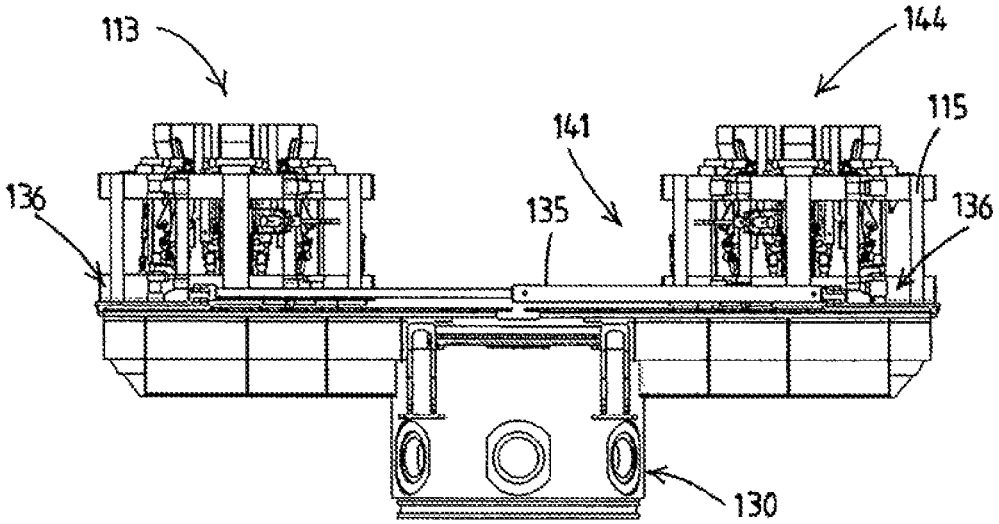
FIG. 16 shows a perspective view of the tubular support structure of FIG. 13 with an alternative cart transport system.
Figure 17:
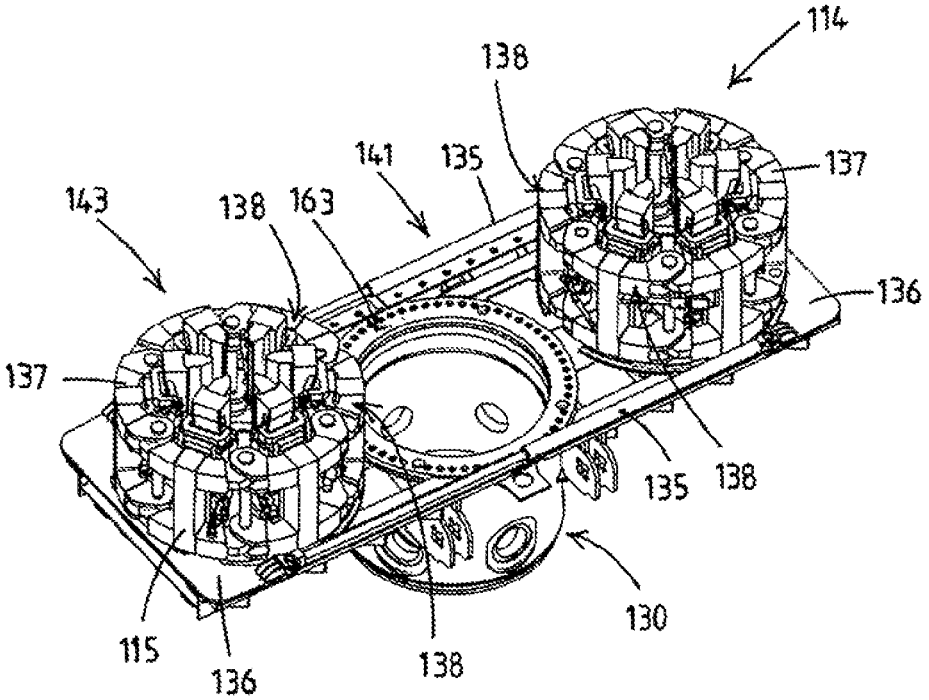
FIG. 17 shows a side view of the tubular support structure of FIG. 16.

According to the invention, the cart transport system comprises one or more transport devices for moving the carts between their secondary position and the central support position. In the particular embodiment shown in FIG. 14, the cart transport system 131 comprises a looped chain 132 on each side of the track formed by the support rails 111. A tubular string support system with an alternative car transport system, deploying hydraulic cylinders for displacing the carts, is shown in FIGS. 16 and 17, and will be discussed in more detail later on.

In the embodiments shown, the cart transport systems are provided with a transport device on opposite sides of the opening, such that a cart is moved by at least two transport devices when being transported between the central support position and its secondary position. The transport devices each comprise a chain 132, extending on opposite sides of the elongated opening and substantially parallel to the rails of the tubular string support system. In the embodiment shown, the chains are looped over sprocket wheels on opposite ends of the tubular support system, at the ends of the track comprising the parallel rails for supporting the carts.

The cart transport device further comprises a drive 133 for pulling the chains along the rails. Each cart is provided with a couple device for coupling the cart with the chains of the transport system. In the embodiment shown, the carts are provided with arms 134 extending adjacent the chains, and provided with openings for receiving a pin or other coupling devices to attach the arms, and thus the carts, to the chains. Once the cart has been secured to the chains, it can be moves along the rails by pulling the chains using the china drive 133.

In an alternative embodiment, a further coupling device, for example a yoke, can be used for connecting the cart with the transport devices of the transport system. In an embodiment, the transport system comprises a yoke for each cart, and preferably at least the hanger body of the cart is rotatably supported in the yoke such that at least the hanger body of the cart can be rotated, relative to the yoke, about a vertical axis of the vertical passage of the hanger body of that cart. The yoke is to be coupled with the transport devices, for example a chain extending along the rails of the tubular string support structure.

FIG. 16 shows a perspective view of the tubular support structure of FIG. 13 with an alternative cart transport system 141. FIG. 17 shows a side view of the tubular support structure of FIG. 16. In the embodiment shown, the transport system comprises a yoke 136 for each cart. The yoke-is a plate shaped table comprising an opening in which the hanger body of the cart is mounted. The hanger body 115 of each the cart 113,114 is rotatably supported in the yoke 136 such that at least the hanger body 115 of the cart can be rotated relative to the yoke, about a vertical axis of the vertical passage of the hanger body of that cart.

The transport devices of the transport system are provided on opposite sides of the track formed by the rails 111, and each comprise a hydraulic cylinder 135. The cylinders extend on opposite sides of the elongated opening and extend in a direction substantially parallel to the rails of the tubular string support system. Each cylinder is coupled with one end to the yoke of one of the two carts and with an opposite end to the yoke of the other of the two carts. Thus, the cylinders of the transport system can be used to pull the carts towards each other, and to push them away from each other.

Each yoke is furthermore provided with a couple device, not shown in the figure, for coupling the yoke to the frame of the transport system, or to for example the hull of the vessel, to secure the cart in its secondary position. Thus, when one yoke is secured in its secondary position, the cylinders can be used to move the other yoke, and thus to move the cart mounted in that yoke between its central support position and its secondary position.

In an alternative embodiment, the transport devices of the cart transport system each comprise two cylinders. Thus, on each side of the track formed by the rails supporting the carts, two cylinders are provided, one cylinder for each cart. The pairs of cylinders provided on opposite sides of the track and elongated opening of the tubular string support structure each extend substantially parallel to the rails. Each cylinder is coupled with one end to a frame of the tubular string support structure and with an opposite end to a yoke. Thus, each yoke is provided with two dedicated cylinders, and can be moved independent of the other yoke.

It is observed that a cart according to the invention comprises at least a hanger body for supporting a tubular or tubular string. The hanger body can be configured for supporting a tubular or tubular string for example by engaging the body of the tubular with clamps, or by providing a support surface for the flange of a tubular body. Also, a hanger body can be configured for both engaging a tubular using clamps and by supporting a tubular flange. Preferably, the hanger body is provided with moveable support devices, for example clamps that can be inserted into the vertical passage of the hanger body to engage a tubular, or dogs that can be inserted into the vertical passage to provide a support surface for supporting the flange of a tubular body. In an embodiment, the hanger body comprises both clamps and dogs, in a further embodiment, dogs and clams are integrated such that the clamps also provide a support surface for supporting the flange of a tubular. In an embodiment, the hanger body is the cart, and no additional devices are provided. In such an embodiment, the hanger body is provided with a skid surface for movement over the rails of the tubular string support structure. In an alternative embodiment, the hanger body is provided with wheels for movement over the rails of the tubular string support structure. In a further embodiment, the hanger body is mounted in a frame, for example such that it can be rotated about a central axis through its vertical passage in said frame. In a further embodiment, the hanger body is supported in a frame which frame is provided with wheels.

Further alternative configurations of the carts of a tubular string support structure according to the invention are also possible within the scope of the invention.

In the embodiment shown in FIGS. 13 and 14, the carts 113,114 each comprise a hanger body 115 that is similar to the one depicted in FIGS. 7-12. FIGS. 15*a*-15*f* show the tubular support structure 103 with the hanger body 115 of one cart in different working positions.

Figure 15A:
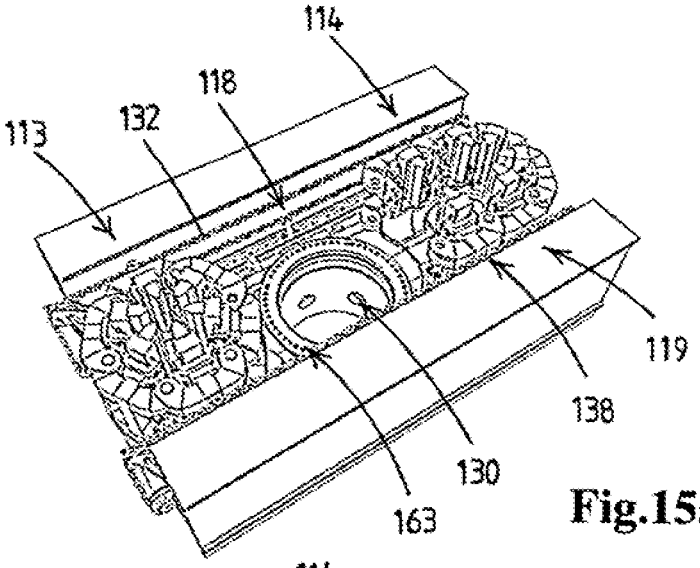
FIG. 15*a*-*f* shows the tubular support structure of the FIG. 13 in different working positions.
Figure 15B:
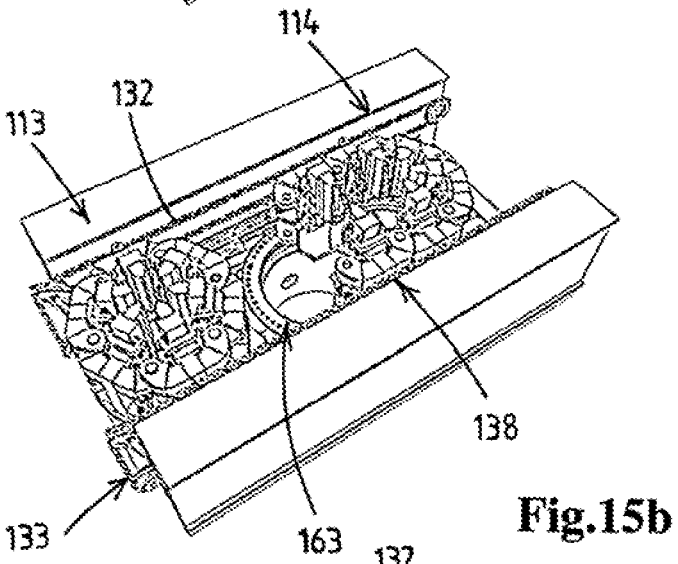
Figure 15C:
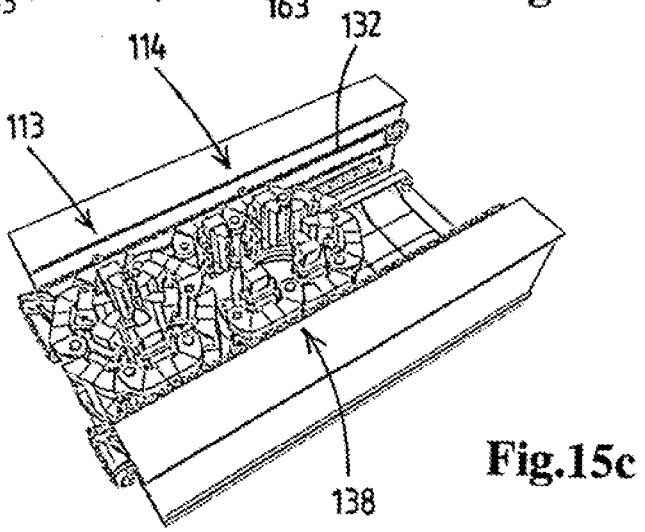
Figure 15D:
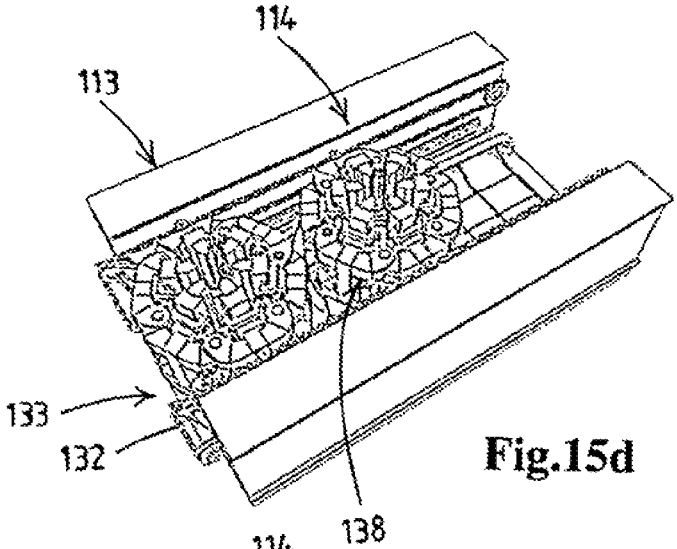
Figure 15E:
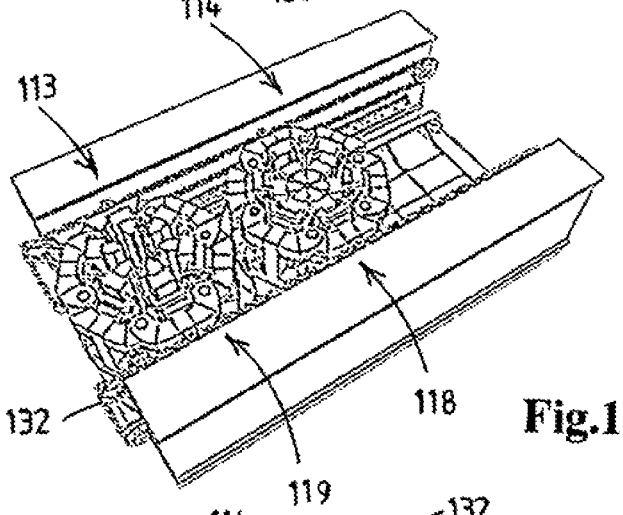
Figure 15F:
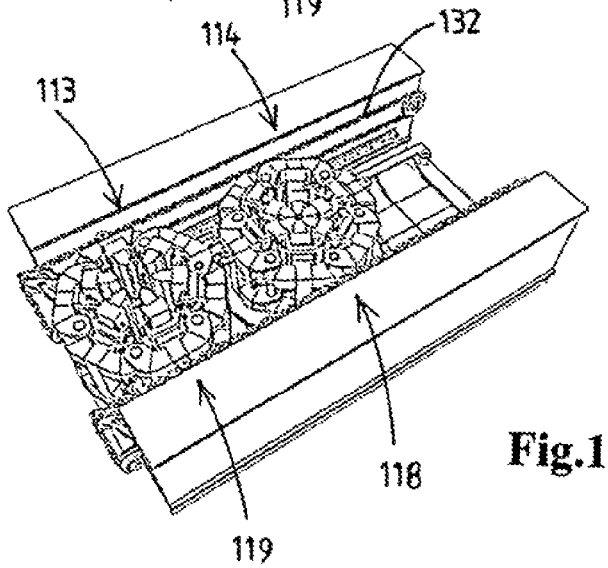

FIGS. 15*a-c* show a cart being moved by the cart transport system into the central support position for engaging a tubular supported in the firing line, for example a tubular that is part of a tubular string supported by a hoisting device of the drilling tower in the firing line. In FIG. 15*d* the doors of the hanger body are closed and locked together, for example by inserting a locking pin, to provide a ring shaped support for the tubular. In FIG. 15*e*, the support devices of the hanger body are inserted into the vertical passage to engage the tubular. In FIG. 15*f*, the cart has been disconnected from the cart transport system, has been secured to the bearing support, and has subsequently be rotated about a central axis of the vertical passage of the hanger body, to thus rotate the tubular supported by the hanger body about its longitudinal axis. It is observed that when the hanger body of the cart is rotatably supported in a yoke, which yoke is coupled with the transport devices of the transport system, there is no need to disconnect the yoke or cart to enable rotation of the cart, more in particular the hanger body. It is furthermore observed that the steps shown in FIGS. 15*a*-15*f* are similar to the ones shown in FIGS. 7-9, be it that in those figures a different embodiment of a tubular string support structure according to the invention has been depicted.

Of the embodiment shown in FIGS. 13 and 14, the hanger body 115 of each cart comprises a frame composed out of multiple frame sections 137. The hanger bodies furthermore comprise two frame sections 138 that function as doors for closing the lateral opening of the hanger body. FIGS. 5*a-c* show the hanger body with the doors open, FIGS. 5*d-f* show the hanger body with the doors closed. With the doors closed and secured to each other, the frame of the hanger body is essentially ring shaped, which is beneficial for supporting the weight of a tubular string engaged in the vertical passage.

The hanger body 115 of the carts 113,114 is furthermore provided with multiple hydraulically actuable support devices 139. In the embodiment shown the support devices 139 are provided in the form of slip like clamps that can be moved into and out of the vertical passage 116 for engaging and releasing respectively a tubular in said vertical passage. FIGS. 15*a-d* show the support devices 139 of the hanger body 115 in their inactive, retracted position. FIGS. 15*e-f* show the support devices 139 of the hanger body 115 in their active clamping position.

In an active extended position, in the support devices extend in the vertical passage of the hanger body for supporting a tubular, and a retracted passive position, in which they allow for passing a tubular through the vertical passage of the hanger body in a vertical direction and/or into and out of the vertical passage via the lateral passage.

It is observed that for the sake of clarity, no tubular has been depicted in the Figs. In practice, the active position of the clamping devices is the position in which the engage the body of the tubular in the firing line, such that the tubular is supported. This position depends on the diameter of the tubular. In the figures, the clamping devices contact each other, such that there is no room for a tubular between them. Thus, when engaging a tubular, the clamping devices will be positioned in a radially more outward position than the position in which they are depicted in these Figs.

Typically, the clamping devices as shown in the embodiment in FIGS. 13-15 can be extended into a range of active positions, such that the active position of the support devices can be adapted to fit the diameter of a tubular in the vertical passage, and the hanger body can thus be used with a range of tubulars.

In an embodiment, the drilling vessel according to the invention comprises a mast type drilling tower, with at least one firing line located outside the mast type construction, and, according to the invention, the at least one firing line extends through an opening in deck, which opening is the centre of a central support position and is located between two secondary positions of the carts, which carts are configured to support a tubular or a tubular string in the firing line when located in the central support position.

It is noted that a drilling tower, in particular a mast type drilling tower, is typically provided with one or more hoisting devices to lift, lower and support objects, such as tubular strings, for example a casing string or a riser string, in the firing line of that drilling tower.

From the foregoing, it will be clear to the skilled person, that within the framework of the invention as set forth in the claims also many variations other than the examples described above are conceivable.

The invention claimed is:

1. A drilling vessel comprising: a drilling tower having a firing line, along which a tubular string is passed into the sea during drilling activities, the firing line extending in a substantially vertical direction; and a tubular string support structure, the support structure comprising: two parallel rails, which rails are provided on opposite sides of an elongated opening, wherein the firing line passes through said elongated opening between the rails; and two carts, each cart having a hanger body capable of independently supporting the tubular string, which hanger body defines a vertical passage adapted to receive a tubular string supported in the firing line, and which hanger body defines a lateral passage, in communication with said vertical passage, allowing to place the tubular string in and remove the tubular string from said vertical passage, wherein the carts are each supported by the parallel rails such that each cart can be moved between a central support position, above the elongated opening with the firing line passing through the vertical passage, and a secondary position above the elongated opening with the firing line passing outside the vertical passage, and wherein, when both carts are located in their secondary position, the carts are located on opposite sides of the firing line, such that between the carts there is a passage for passing through large objects along the firing line.

2. The drilling vessel according to claim 1, wherein both carts are at opposite sides of the lateral passage provided with couple devices for cooperating with couple devices of an object located in the firing line, and wherein both carts can be positioned partially in or adjacent to the central support position at the same time, such that the carts can together engage such an object to support it in the firing line.

3. The drilling vessel according to one claim 1, wherein the hanger body of at least one cart is configured with the vertical passage having a diameter wider than the lateral passage, such that, when seen in top view, the combined vertical passage and lateral passage form a key hole shaped opening.

4. The drilling vessel according to claim 1, wherein at least one cart is provided with a closing device configured for closing the lateral passage, which closing device is a door that can block the lateral passage and is designed to provide the hanger body with a ring shaped vertical passage when the lateral passage is closed.

5. The drilling vessel according to claim 1, wherein both carts are configured for performing the same function, but differ in the diameter of the tubular they can handle such that one cart can be used with tubulars having a first diameter and not with tubulars having a second diameter, and the other cart can be used with tubulars having the second diameter and not with tubulars having the first diameter.

6. The drilling vessel according to claim 1, wherein the tubular string support structure is configured for supporting at least one auxiliary device at the central support position, such that the auxiliary device is supported below a cart located in the central support position, and which at least one auxiliary device can be lowered into said position and can be lifted out of said position when the carts are both in their secondary position.

7. The drilling vessel according to claim 1, wherein the tubular string support structure further comprises a bearing support, the bearing support defining an opening concentric with the firing line, which bearing support enables rotating a cart, when located in the central support position, about a vertical axis of the vertical passage of the hanger body of that cart.

8. The drilling vessel according to claim 1, wherein the tubular string support further comprises a diverter, located concentric with the firing line.

9. The drilling vessel according to claim 1, wherein the drilling tower is a mast type tower with the firing line located outside the mast, and wherein the secondary position of one of the carts is located between the central support position and the mast.

10. The drilling vessel according to claim 1, wherein the tubular string support further comprises a cart transport system, which cart transport system comprises one or more transport devices, such as a hydraulic cylinder or a looped chain or wire, for moving the carts between their secondary position and the central support position.

11. The drilling vessel according to claim 10, wherein the transport system further comprises a yoke for each cart, and wherein at least the hanger body of the cart is rotatably supported in the yoke such that at least the hanger body of the cart can be rotated, relative to the yoke, about a vertical axis of the vertical passage of the hanger body of that cart.

12. The drilling vessel according to claim 11, wherein the transport devices each comprise a cylinder, the cylinders extending on opposite sides of the elongated opening and extend in a direction substantially parallel to the rails of the tubular string support system, wherein each cylinder is coupled with one end to the yoke of one of the two carts and with an opposite end to the yoke of the other of the two carts, and wherein each yoke and/or each cart is provided with a couple device for coupling the yoke and/or the cart to a frame of the transport system to secure the cart in its secondary position.

13. The drilling vessel according to claim 1, wherein the hanger body of each cart comprises a frame composed out of multiple frame sections, which frame sections are hingeably connected, and wherein one or more frame sections of the frame can be pivoted between an open position, in which the frame sections form a C-shaped hanger body, and a closing position, in which the pivotable frame sections close the lateral passage of the hanger body.

14. The drilling vessel according to claim 1, wherein the hanger body of at least one cart, is provided with multiple actuable support devices, which support devices can be moved into and out of the vertical passage for engaging and releasing respectively a tubular in said vertical passage.

15. The drilling vessel according to claim 14, wherein the support devices can be moved between an active extended position, in which they extend in the vertical passage of the hanger body for supporting a tubular, and a retracted passive position, in which they allow for passing a tubular through the vertical passage of the hanger body in a vertical direction and/or into and out of the vertical passage via the lateral passage.

16. The drilling vessel according to claim 15, wherein the support devices can be extended into a range of active positions, such that the active position of the support devices can be adapted to fit the diameter of a tubular in the vertical passage, and the hanger body can thus be used with a range of tubulars.

17. The drilling vessel according to claim 1, wherein the drilling vessel further comprises a drilling deck, which drilling deck has a drilling deck top surface, and wherein the tubular string support structure is recessed in the drilling deck such that it supports the two carts within the drilling deck, just below the drilling deck top surface.

18. The drilling vessel according to claim 17, wherein the drilling vessel further comprises a moonpool with a moonpool deck, and wherein the drilling deck is located above said moonpool deck.

19. The drilling vessel according to claim 1, wherein the tubular string support structure further comprises a frame, the frame connecting at least the two parallel rails such that the tubular string support can be provided as a module for retrofitting in existing drilling vessels to provide the drilling vessel.

20. A method for assembling and lowering a tubular string comprising tubulars with a wide cross section and tubulars with a narrow cross section using the drilling vessel according to claim 1, the method comprising the steps of:

providing a first cart having a clamping device for engaging the tubulars with the wide cross section;

providing a second cart having a clamping device for engaging the tubulars with the narrow cross section;

supporting a wide cross section tubular in the firing line using a hoist system of the drilling tower;

moving the first cart into the central support position, thus moving the tubular string, supported by the hoist system of the drilling tower, through the lateral passage of the hanger body of the first cart;

clamping the wide cross section tubular in the firing line using the clamping device of the first cart, and supporting said wide cross section tubular in the firing line;

uncoupling the tubular string form the hoist system of the drilling tower;

attaching another wide cross section tubular to said wide cross section tubular to form a tubular string;

coupling the tubular string to the hoist system of the drilling tower;

releasing the tubular string with the clamping device of the first cart;

lowering the tubular string using the hoist system of the drilling tower;

engaging the upper end of the tubular string with the clamping device of the first cart and supporting the tubular string in the firing line;

uncoupling the tubular string form the hoist system of the drilling tower;

attaching a narrow cross section tubular to said wide cross section tubular of the tubular string supported in the firing line;

coupling the tubular string to the hoist system of the drilling tower releasing the tubular string with the clamping device of the first cart;

lowering the tubular string using the hoist system of the drilling tower, and supporting the tubular string in the firing line using the hoist system of the drilling tower;

moving the first cart out of the central support position and into its secondary position, thus moving the tubular string, supported by the hoist system of the drilling tower, through the lateral passage of the hanger body of the first cart;

moving the second cart from its secondary position into the central support position, thus moving the tubular string, supported by the hoist system of the drilling tower, through the lateral passage of the hanger body of the second cart;

engaging the upper end of the tubular string with the clamping device of the second cart and supporting the tubular string in the firing line;

uncoupling the tubular string from the hoist system of the drilling tower;

attaching another narrow cross section tubular to the riser string;

coupling the tubular string to the hoist system of the drilling tower releasing the tubular string with the clamping device of the second cart;

lowering the tubular string using the hoist system of the drilling tower, and supporting the tubular string in the firing line using the hoist system of the drilling tower; and engaging the upper end of the tubular string with the second clamp.

* * * * *